US012320575B2

(12) United States Patent
Kim et al.

(10) Patent No.: US 12,320,575 B2
(45) Date of Patent: Jun. 3, 2025

(54) REFRIGERATOR

(71) Applicant: LG Electronics Inc., Seoul (KR)

(72) Inventors: Ki Hwang Kim, Seoul (KR); Sung Hee Kang, Seoul (KR); Dong Hwi Kim, Seoul (KR); Woo Jin Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 257 days.

(21) Appl. No.: 17/917,694

(22) PCT Filed: Sep. 25, 2020

(86) PCT No.: PCT/KR2020/013151
§ 371 (c)(1),
(2) Date: Oct. 7, 2022

(87) PCT Pub. No.: WO2021/210738
PCT Pub. Date: Oct. 21, 2021

(65) Prior Publication Data

US 2023/0152025 A1 May 18, 2023

(30) Foreign Application Priority Data

Apr. 16, 2020 (KR) ..... 10-2020-0046113

(51) Int. Cl.
*F25D 17/06* (2006.01)
*F25D 11/02* (2006.01)

(52) U.S. Cl.
CPC ..... *F25D 17/065* (2013.01); *F25D 11/02* (2013.01); *F25D 17/067* (2013.01); *F25D 2317/061* (2013.01); *F25D 2323/021* (2013.01)

(58) Field of Classification Search
CPC ..... F25D 17/065; F25D 11/02; F25D 17/067; F25D 2317/061; F25D 2323/021; F25D 17/08
See application file for complete search history.

(56) References Cited

U.S. PATENT DOCUMENTS 5,816,061 A 10/1998 Lee et al.
2016/0153693 A1* 6/2016 Oyu ..... F25D 17/08 62/276

FOREIGN PATENT DOCUMENTS

CN 108518909 A 9/2018
DE 202005005940 U1 8/2006
(Continued)

OTHER PUBLICATIONS

Extended European Search Report in European Appln. No. 20930871.7, mailed on Apr. 23, 2024, 9 pages.

*Primary Examiner* — Cassey D Bauer
(74) *Attorney, Agent, or Firm* — Fish & Richardson P.C.

(57) ABSTRACT

A refrigerator is proposed. In the refrigerator, a cool air passage for a freezing compartment which guides the flow of cool air to the freezing compartment, and a cool air passage for an ice-making compartment which guides the flow of cool air to the ice-making compartment partially share the cool air with each other. Through the sharing of cool air, the amount of cool air supplied to the freezing compartment is increased and sufficient cool air is supplied to the refrigerating compartment. Accordingly, sufficient cool air is supplied to the refrigerating compartment, the freezing compartment, and the ice-making compartment even with a single evaporator.

20 Claims, 44 Drawing Sheets

(56) References Cited

FOREIGN PATENT DOCUMENTS

| | | | | |
|---|---|---|---|---|
| EP | 1517103 | A2 | 3/2005 | |
| EP | 3217126 | A1 * | 9/2017 | ..... F25D 11/00 |
| JP | H05-126453 | A | 5/1993 | |
| WO | WO 2011007960 | A2 | 1/2011 | |

* cited by examiner

REFRIGERATOR

CROSS-REFERENCE TO RELATED APPLICATIONS

This application is a National Stage application under 35 U.S.C. § 371 of International Application No. PCT/KR2020/013151, filed on Sep. 25, 2020, which claims the benefit of Korean Patent Application No. 10-2020-0046113, filed on Apr. 16, 2020. The disclosures of the prior applications are incorporated by reference in their entirety.

TECHNICAL FIELD

The present disclosure relates to a refrigerator having a refrigerating compartment and a freezing compartment that respectively provide storage spaces and having an ice-making compartment provided in a refrigerating compartment door.

BACKGROUND ART

Generally, a refrigerator is a home appliance that is provided to store various foods or beverages for a long time by cool air generated by circulation of a refrigerant according to a refrigeration cycle.

The refrigerator is configured of one or a plurality of partitioned storage compartments for cooling an object to be stored. Each of the storage compartments may be opened or closed by a rotary type door, or may be ejected and retracted in a drawer manner.

In particular, the storage compartments may include a freezing compartment for freezing the object to be stored and a refrigerating compartment for refrigerating the object to be stored. In addition, the storage compartments may include at least two freezing compartments or at least two refrigerating compartments.

In recent refrigerators, an ice-making compartment is provided in a refrigerating compartment door so that a user can take out ice without opening the freezing compartment.

That is, cool air has passed through an evaporator in a cabinet is supplied to the refrigerating compartment door through a cool air duct the ice-making compartment. When the refrigerating compartment door is closed, the cool air is supplied to the ice-making compartment through a connection passage provided in the refrigerating compartment door by the cool air duct for the ice-making compartment.

The above refrigerator is proposed in various related art, such as Korean Patent No. 10-1639443, Korean Patent Application Publication No. 10-2009-0101525, and Korean Patent No. 10-1659622.

In particular, the above-described refrigerator having the ice-making compartment at the refrigerating compartment door is configured to selectively supply cool air to the refrigerating compartment, the freezing compartment, and the ice-making compartment by using a single evaporator.

However, the refrigerator according to the above related art has a problem in that sufficient cool air is not supplied to the refrigerating compartment or the freezing compartment due to the configuration in which cool air is supplied to the three chambers using the single evaporator.

In particular, in the conventional refrigerator, a refrigerating compartment side grille fan assembly supplying cool air to the refrigerating compartment side is configured to supply the same amount of cool air to opposite spaces in the refrigerator. However, although the amounts of cool air required for port ions in the refrigerating compartment are different from each other, since cool air is uniformly discharged to all portions regardless of the amount of cool air required for the portions, the temperatures of the portions in the refrigerating compartment are ununiform.

That is, a portion where cool air is supplied excessively compared to a required amount of cool air and a portion where cool air is provided insufficiently compared to a required amount of cool air are mixed in the refrigerating compartment. Accordingly, a temperature difference between the portions of the refrigerating compartment occurs.

For example, in a structure in which an ice-making compartment is provided in one refrigerating compartment door of two refrigerating compartment doors, the refrigerating compartment door (ice-making compartment side refrigerating compartment door) on a side where the ice-making compartment is located has a direct cooling effect provided by the ice-making compartment, so it is sufficient for an ice-making compartment side refrigerating compartment door to receive only a relatively small amount of cool air compared to the refrigerating compartment door at the opposite side. However, since the refrigerator is configured to uniformly supply cool air to the opposite sides where the two refrigerating compartment doors are located, the temperature for each portion in the refrigerating compartment is inevitably ununiform.

Conventionally, a passage supplying cool air from the freezing compartment to the refrigerating compartment is configured as a structure integrally formed with the freezing compartment or the refrigerating compartment. Therefore, maintenance thereof is not easy, and when changing a refrigerator model, it is difficult to use common components in the refrigerator.

DISCLOSURE

Technical Problem

Accordingly, the present disclosure has been made keeping in mind the above problems occurring in the prior art, and an objective of the present disclosure is to provide a refrigerator capable of reducing an unnecessary amount of cool air supplied to an ice-making compartment side refrigerating compartment door and capable of supplying sufficient cool air to a refrigerating compartment door opposite thereto.

Another objective of the present disclosure is to provide a refrigerator capable of allowing cool air blown from a freezing compartment side grille fan assembly to be smoothly supplied to a refrigerating compartment side grille fan assembly and capable of facilitating maintenance thereof.

Another objective of the present disclosure is to increase the number of components commonly used regardless of the model of refrigerator.

Technical Solution

In the refrigerator of the present disclosure in order to achieve the above objectives, a freezing compartment side grille fan assembly and a refrigerating compartment side grille fan assembly may be configured to receive cool air through a connection passage.

The refrigerator of the present disclosure may be configured such that the refrigerating compartment side grille fan assembly supplies different amounts of cool air to spaces of opposite sides in a refrigerating compartment. Whereby, cool air may be sufficiently supplied to the refrigerating compartment and a freezing compartment, and an ice-making compartment by a single evaporator, and the amount of supplying cool air for each portion in the refrigerating compartment may vary.

In the refrigerator of the present disclosure, an upper grille panel and a duct unit of the refrigerating compartment side grille fan assembly may be configured as separate structures to be separated from each other. Whereby, only the duct unit may be replaced depending on the type of refrigerator, so the upper grille panel may be used commonly.

The refrigerator of the present disclosure may have a blocking plate at a rear surface of the duct unit. Whereby, the temperature of cool air flowing along a refrigerating compartment side cool air passage is prevented from being increased.

In the refrigerator of the present disclosure, an upper end of the upper grille panel may have a cool air discharge guide. Whereby, cool air flowing along the refrigerating compartment side cool air passage may be discharged to an upper space in the refrigerating compartment.

In the refrigerator of the present disclosure, a protrusion may be formed by being extended from a lower portion of the duct unit. Whereby, cool air supplied from the freezing compartment side grille fan assembly may be supplied to two refrigerating compartment side cool air passages that are divided to opposite sides of the rear surface of the duct unit.

In the refrigerator of the present disclosure, a lower connection duct may be provided in the protrusion of the duct unit. Whereby, connection or separation of the connection passage may be performed easily.

In the refrigerator of the present disclosure, the lower connection duct may be removably coupled to at least one portion of the protrusion and the connection passage. Whereby, the refrigerating compartment side grille fan assembly may be separated from the connection passage.

In the refrigerator of the present disclosure, a passage gate may be provided in a cool air outlet side of the lower connection duct. Whereby, when the lower connection duct is separated from the refrigerating compartment side grille fan assembly, it is possible to perform maintenance of the passage gate.

In the refrigerator of the present disclosure, a lower grille panel that partitions the protrusion from the inside of the refrigerating compartment may be provided. Whereby, unintentional separation between the protrusion and the connection passage is prevented.

In the refrigerator of the present disclosure, a recovery duct for the refrigerating compartment is configured such that a first end thereof is connected to a lower portion of a rear surface of the lower grille panel and a second end thereof is connected to a cool air inlet side of the evaporator. Whereby, cool air recovered from the refrigerator may be supplied to the refrigerating compartment, the freezing compartment, or the ice-making compartment after moisture in the cool air is removed by the evaporator.

In the refrigerator of the present disclosure, the cool air passage for the refrigerating compartment may include a first cool air passage for the refrigerating compartment, a second cool air passage for the refrigerating compartment, and a third cool air passage for the refrigerating compartment. Whereby, cool air introduced through the third cool air passage for the refrigerating compartment may be dispersively supplied to the first cool air passage for the refrigerating compartment and the second cool air passage for the refrigerating compartment.

In the refrigerator of the present disclosure, the passage gate may be located in the third cool air passage for the refrigerating compartment. Whereby, maintenance of the passage gate may be facilitated.

In the refrigerator of the present disclosure, the second cool air passage for the refrigerating compartment may be configured to receive a larger amount of cool air than the first cool air passage for the refrigerating compartment. Whereby, compared to the space where the ice-making compartment is located in the refrigerating compartment, the space opposite to the space having the ice-making compartment may receive more cool air, and the temperature in the refrigerating compartment may be uniformly maintained over the entire portions therein.

In the refrigerator of the present disclosure, a cool air outlet side of the third cool air passage for the refrigerating compartment may be inclined or rounded such that cool air flows toward the second cool air passage for the refrigerating compartment. Whereby, more cool air may be supplied to the second cool air passage for the refrigerating compartment.

In the refrigerator of the present disclosure, a transverse width of the second cool air passage for the refrigerating compartment may be configured to be wider than a transverse width of the first cool air passage for the refrigerating compartment. Whereby, more cool air may be supplied to the second cool air passage for the refrigerating compartment.

In the refrigerator of the present disclosure, a second cool air outlet for the middle compartment formed in the second cool air passage for the refrigerating compartment may be configured to discharge more cool air compared to a first cool air outlet for a middle compartment formed in the first cool air passage for the refrigerating compartment.

The refrigerator of the present disclosure may include an upper connection duct. Whereby, cool air flowing along the cool air passage for the refrigerating compartment may be directly supplied to a front space in the refrigerating compartment.

The refrigerator of the present disclosure may include a cool air outlet connected to an upper surface of the freezing compartment side grille fan assembly. Whereby, cool air may be supplied to the refrigerating compartment side grille fan assembly through the connect ion passage connected to the cool air outlet.

In the refrigerator of the present disclosure, as the cool air outlet goes upward, the passage may be gradually increased in size. Whereby, sufficiently more cool air may be supplied to the refrigerating compartment side grille fan assembly.

Advantageous Effects

As described above, the shared passages are provided in the refrigerator of the present disclosure, so that the cool air passage for the freezing compartment and the cool air passage for the ice-making compartment are shared with each other. Accordingly, even when the freezing fan and the ice-making fan are operated at the same time, sufficient cool air can be supplied to the freezing compartment, and when only the ice-making fan is operated, the back flow of cool air from the freezing compartment can be prevented.

The refrigerator of the present disclosure is configured such that the open port ion of the cool air out let side of the shared passage does not face the freezing fan module. Accordingly, there is an effect that the cool air provided from the cool air passage for the ice-making compartment through the shared passage does not interfere with the flow of the cool air flowing in the cool air passage for the freezing compartment.

The refrigerator of the present disclosure is configured such that the lower shared passage is formed in a lower surface (the second circumferential passage rib) of the installation portion of the ice-making fan module, and the extension passage extended to a lower compartment of the freezing compartment is additionally formed in the shroud. Therefore, sufficient cool air can be supplied to the lower compartment of the freezing compartment.

In particular, the drainage hole is additionally formed in the extension passage, and the lower shared passage is formed by penetrating between the second circumferential passage rib and the wall surface of the shroud. Accordingly, there is an effect that condensed water or moisture in the installation portion of the ice-making fan module can be smoothly discharged to the outside of the freezing compartment.

The refrigerator of the present disclosure is configured to have the guide formed on each wall surface in the cool air passage for the freezing compartment, so that the cool air flowing in the cool air passage for the freezing compartment can be supplied differently for each portion in the freezing compartment. Accordingly, there is an effect that the freezing efficiency can be improved.

The refrigerator of the present disclosure is configured to supply the cool air to the cool air passage for the refrigerating compartment of the refrigerating compartment side grille fan assembly through the cool air outlet formed in the upper wall surface of the cool air passage for the freezing compartment and the connection duct connected to the cool air outlet. Accordingly, there is an effect that the single evaporator can selectively supply cool air to the refrigerating compartment, the freezing compartment, and the ice-making compartment.

MODE FOR INVENTION

Hereinbelow, an exemplary embodiment with respect to a refrigerator of the present disclosure will be described in detail with reference to accompanying FIGS. 1 to 45.

Figure 1:
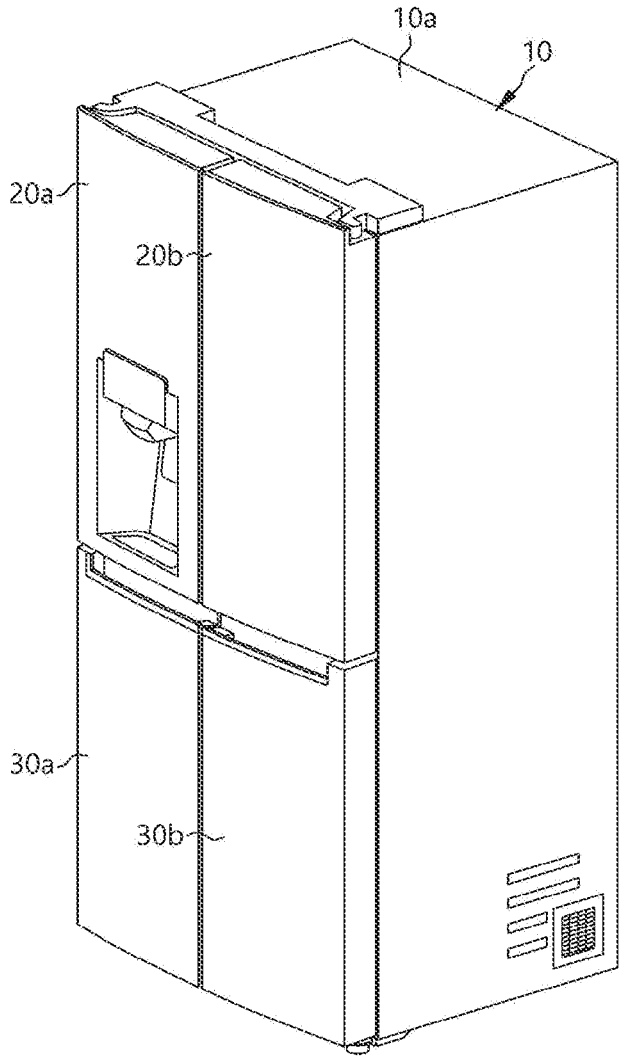
FIG. 1 is a perspective view showing an external appearance of a refrigerator according to an embodiment of the present disclosure.
Figure 2:
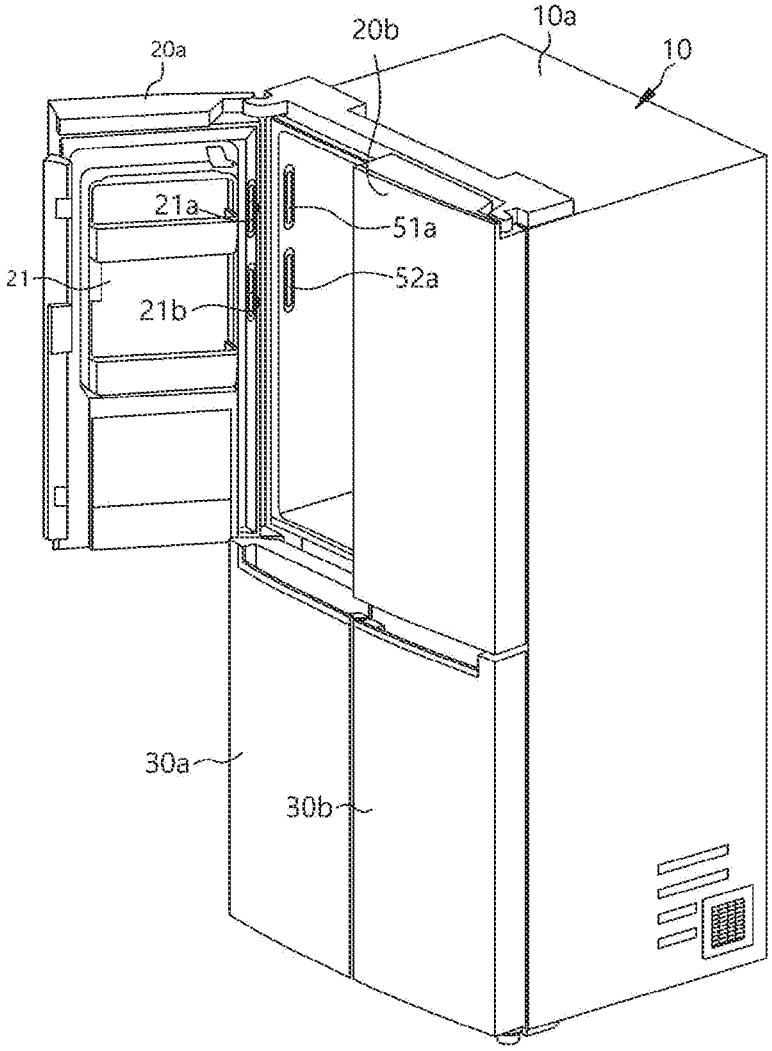
FIG. 2 is a perspective view showing a state in which a refrigerating compartment door at an ice-making compartment of the refrigerator according to the embodiment of the present disclosure.
Figure 3:
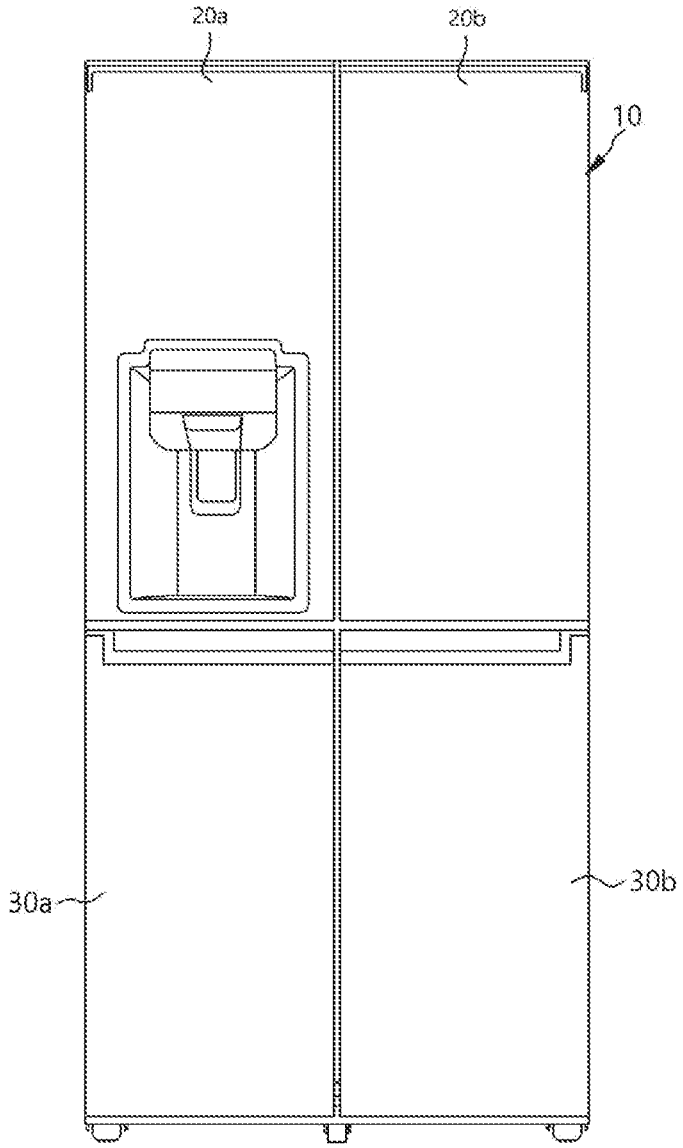
FIG. 3 is a front view schematically showing an external structure of the refrigerator according to the embodiment of the present disclosure.

FIG. 1 is a perspective view showing an external appearance of the refrigerator according to the embodiment of the present disclosure. FIG. 2 is a perspective view showing a state in which a refrigerating compartment door at an ice-making compartment of the refrigerator according to the embodiment of the present disclosure. FIG. 3 is a front view schematically showing an external structure of the refrigerator according to the embodiment of the present disclosure.

Figure 4:
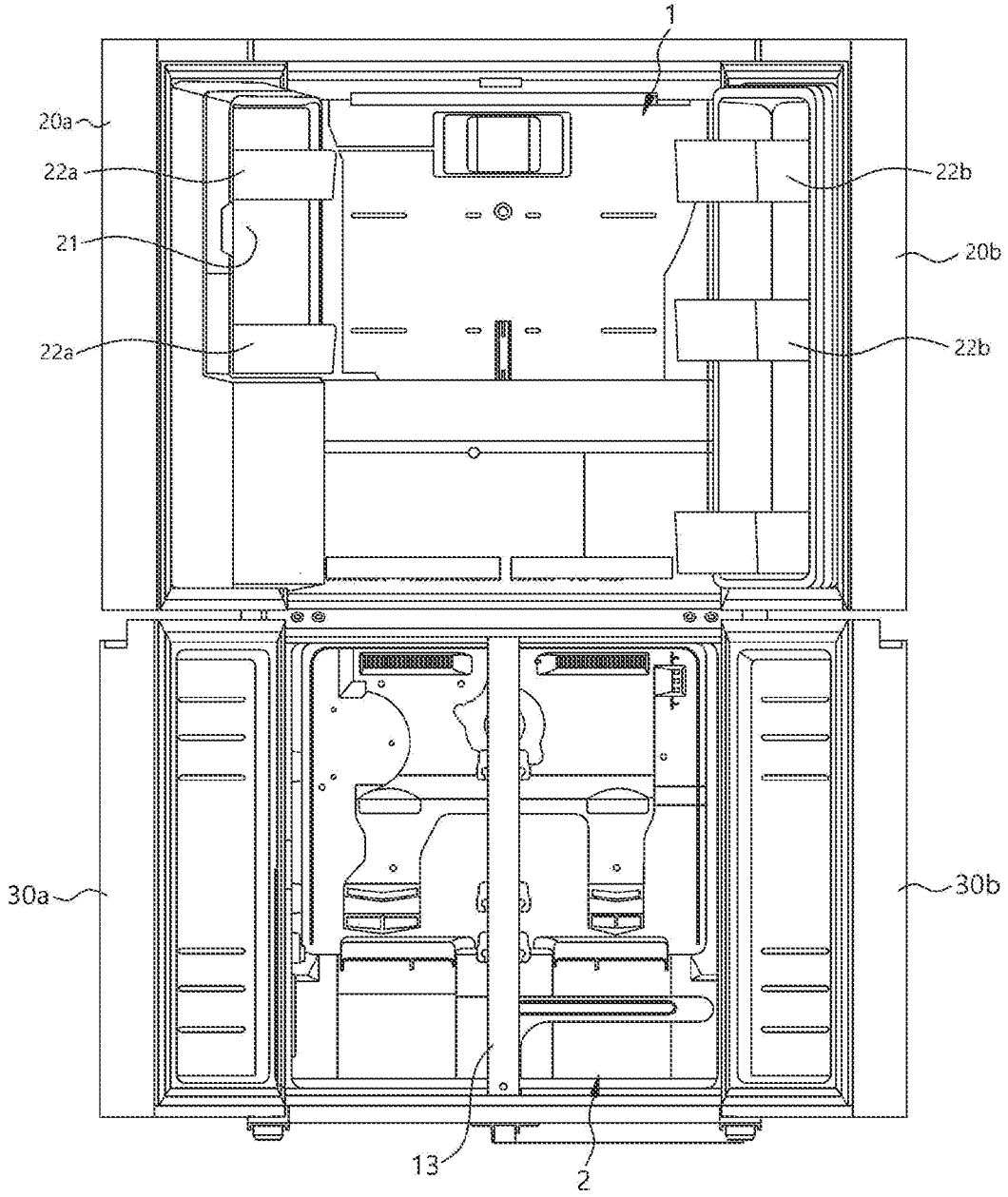
FIG. 4 is a front view showing an inner structure of the refrigerator according to the embodiment of the present disclosure in a state in which two refrigerating compartment doors and two freezing compartment doors are opened.
Figure 5:
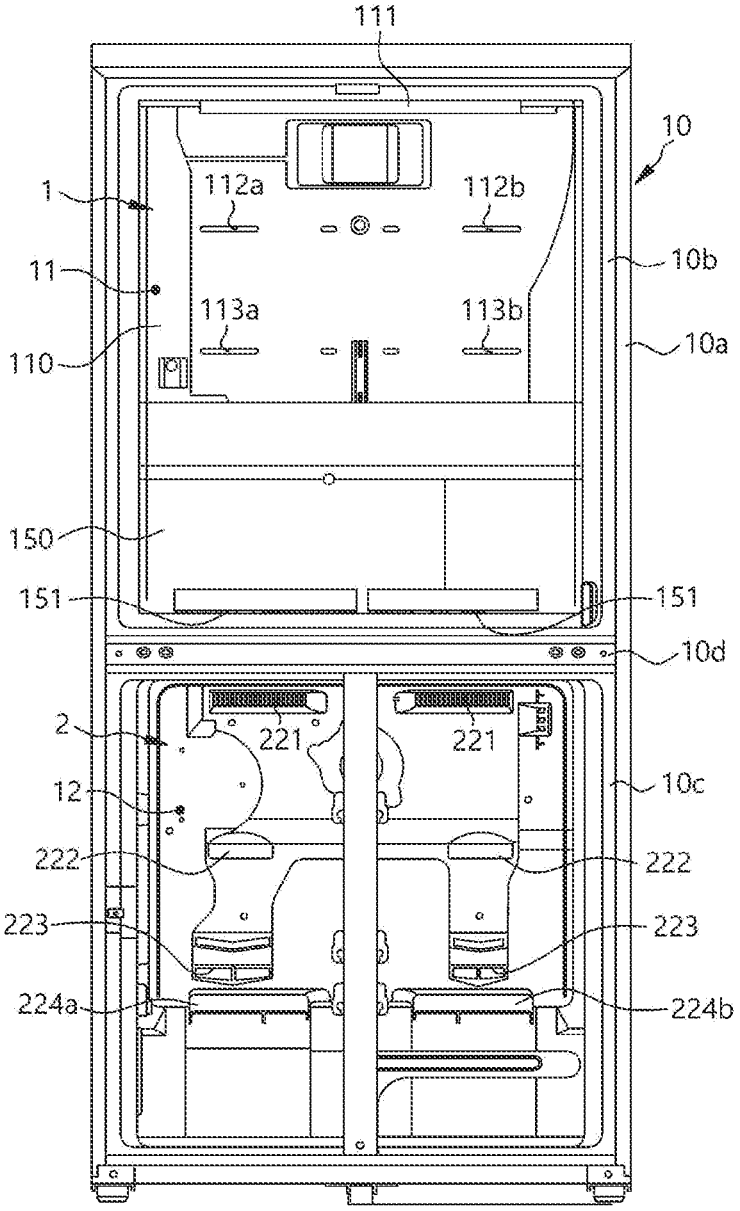
FIG. 5 is a front view showing the inner structure of the refrigerator according to the embodiment of the present disclosure in a state in which the two refrigerating compartment doors and the two freezing compartment doors are omitted.
Figure 6:
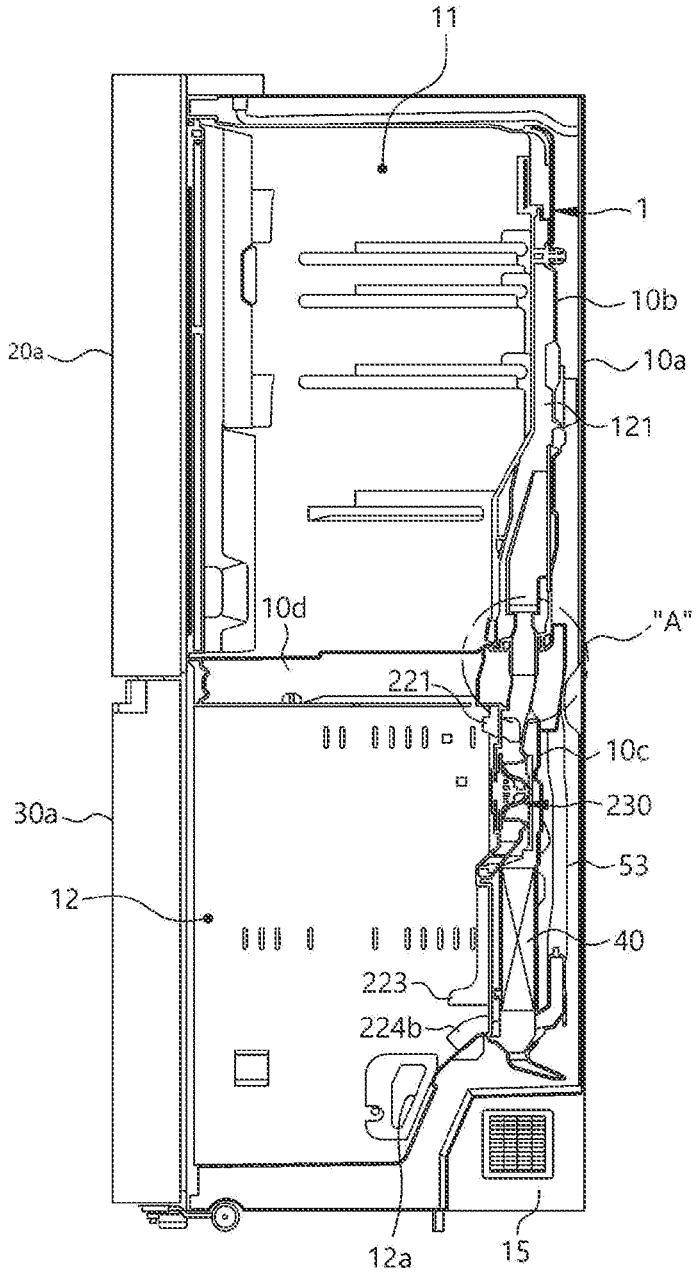
FIG. 6 is a side section view showing the inner structure of the refrigerator according to the embodiment of the present disclosure.
Figure 7:
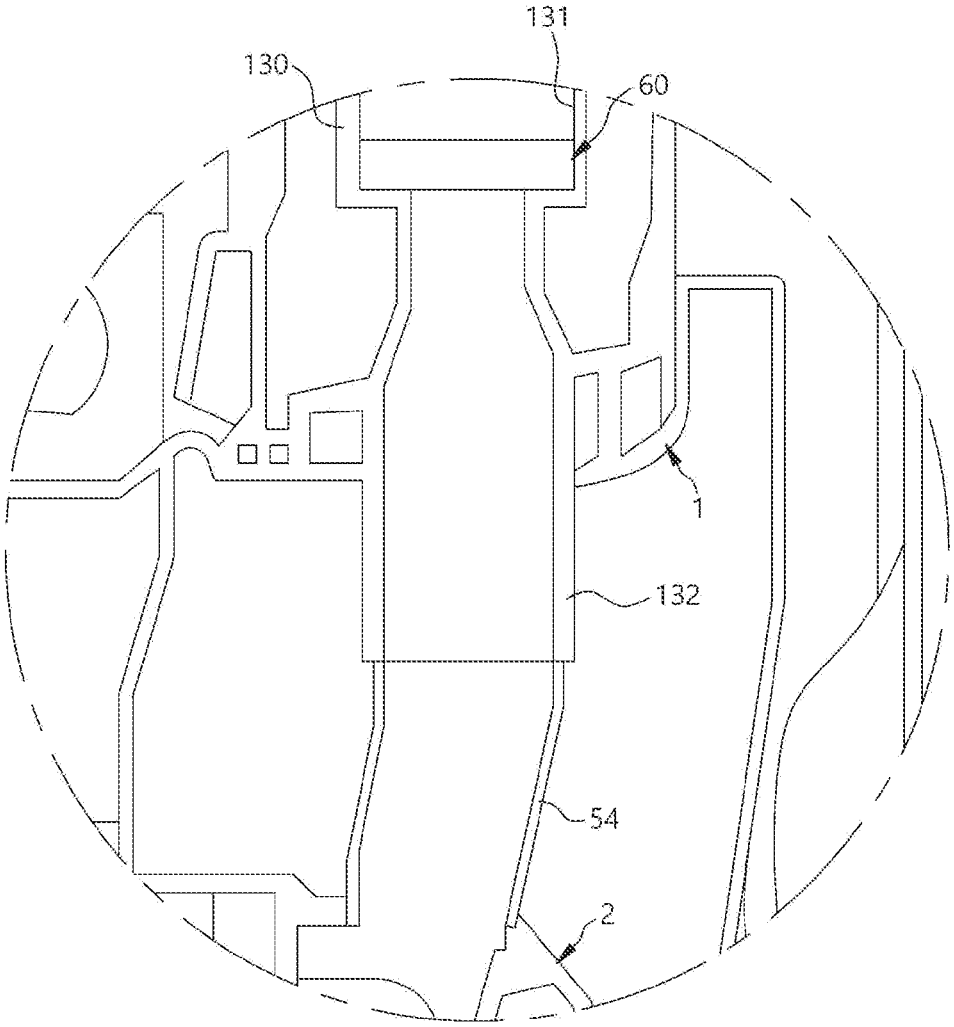
FIG. 7 is an enlarged view of part A in FIG. 6.

FIG. 4 is a front view showing an inner structure of the refrigerator according to the embodiment of the present disclosure in a state in which two refrigerating compartment doors and two freezing compartment doors are opened. FIG. 5 is a front view showing the inner structure of the refrigerator according to the embodiment of the present disclosure in a state in which the two refrigerating compartment doors and the two freezing compartment doors are omitted. FIG. 6 is a side section view showing the inner structure of the refrigerator according to the embodiment of the present disclosure.

As shown in the drawings, the refrigerator according to the embodiment of according to the embodiment of the present disclosure includes a cabinet 10 having a refrigerating compartment 11 and a freezing compartment 12, and a refrigerating compartment door 20*a* having an ice-making compartment 21. The refrigerating compartment 11 receives cool air from a refrigerating compartment side grille fan assembly 1. The ice-making compartment 21 is located in either refrigerating compartment door 20*a* and receives cool air from a freezing compartment side grille fan assembly 2 together with the freezing compartment 12.

In addition, the cool air is generated in a single evaporator 40 and then is supplied to the refrigerating compartment 11, the freezing compartment 12, and the ice-making compartment 21 through the refrigerating compartment side grille fan assembly 1 and the freezing compartment side grille fan assembly 2.

In particular, the refrigerating compartment side grille fan assembly 1 selectively receives cool air from the freezing compartment side grille fan assembly 2 by a connection passage 54 and a passage gate 60. The refrigerating compartment side grille fan assembly 1 is configured to supply different amounts of cool air to a space having the first refrigerating compartment door 20*a* and a space having a second refrigerating compartment door 20*b* of spaces of opposite sides in the refrigerating compartment 11.

Accordingly, sufficient cool air may be supplied to the refrigerating compartment 11, the freezing compartment 12, and the ice-making compartment 21 by the single evaporator 40, and the entire area in the refrigerating compartment 11 may be maintained at a uniform temperature through different supply of cool air considering the situation of each portion in the refrigerating compartment 11.

The refrigerator according to the embodiment of the present disclosure will be described in detail as follows.

First, the refrigerating compartment 11 is a storage compartment provided to refrigerate the object to be stored, and the freezing compartment 12 is a storage compartment provided to freeze the object to be stored.

The refrigerating compartment 11 is provided in an upper space in the cabinet 10, and the freezing compartment 12 is provided in a lower space in the cabinet 10.

The cabinet 10 may consist of an outer casing 10*a* forming an external surface of the refrigerator and two inner casings 10*b* and 10*c* forming an inner surface of the refrigerator.

In the two inner casings 10*b* and 10*c*, an upper inner casing 10*b* (hereinbelow, upper inner casing refers to "inner casing for refrigerating compartment") is a portion providing the refrigerating compartment 11, and a lower inner casing 10*c* (hereinbelow, lower inner casing refers to "inner casing for freezing compartment") is a portion providing the freezing compartment 12. The inner casing 10*b* for the refrigerating compartment and the inner casing 10*c* for the refrigerating compartment are formed in a box shape with an open front surface, and are formed to be spaced apart from each other.

That is, an inside space of the inner casing 10*b* for the refrigerating compartment is used as the refrigerating compartment 11 that is open at a front surface thereof, and an inside space of the inner casing 10*c* for the refrigerating compartment is used as the freezing compartment 12 that is open at a front surface thereof.

A partition wall 10*d* (referring to FIGS. 4 and 6) may be provided in a space between the two inner casings 10*b* and 10*c*. The partition wall 10*d* may be a separate frame placed between the two inner casings 10*b* and 10*c*, may be a filling material filling between the two inner casings 10*b* and 10*c*, or may be configured as a void.

Further, the open front surface of the refrigerating compartment 11 is configured to be opened and closed by a refrigerating compartment door 20*a*, 20*b*, and the open front surface of the freezing compartment 12 is configured to be opened and closed by a freezing compartment door 30*a*, 30*b*.

The refrigerating compartment door 20*a*, 20*b* is configured as two doors, and configured as double-door type rotary doors (a door installed to be horizontally rotatable) that may respectively open and close opposite sides of the refrigerating compartment 11. The freezing compartment door 30*a*, 30*b* may be configured as two doors, and configured as double-door type rotary doors (a door installed to be horizontally rotatable) that may respectively open and close opposite sides of the freezing compartment 12.

In particular, the ice-making compartment 21 is provided at an inside (a side located in the refrigerating compartment when the refrigerating compartment door is closed) of either refrigerating compartment door 20*a* (hereinbelow, the door refers to a "first refrigerating compartment door") of the two refrigerating compartment doors 20*a* and 20*b*. The ice-making compartment 21 is a storage compartment having an ice tray (not shown) for making ice at the refrigerating compartment door 20*a*. The ice-making compartment 21 is configured to have a space partitioned from the refrigerating compartment 11. The first refrigerating compartment door 20*a* is a refrigerating compartment door located on the left side when the refrigerator is viewed from the front (referring to FIGS. 3 and 4).

Another refrigerating compartment door 20*b* (hereinbelow, the door refers to "second refrigerating compartment door") of the two refrigerating compartment doors 20*a* and 20*b* is provided to open and close another space in the refrigerating compartment 11.

Meanwhile, storage boxes 22*a* and 22*b* for storing an object to be stored may be provided in inside wall surfaces (wall surfaces exposed into the refrigerating compartment) of the first refrigerating compartment door 20*a* and the second refrigerating compartment door 20*b*.

Seated port ions of the upper, middle, and lower compartments are provided for each of left and right spaces in the refrigerating compartment 11. In each seated portion, a drawer box (not shown) may be provided to store the objects to be stored.

The drawer box may be installed to be ejected and retracted in a drawer manner. The drawer box in each of the compartments may be configured such that an upper end of the drawer box is spaced apart from a lower surface of another drawer box that is located on an upper side thereof. That is, through the space between the drawer boxes, cool air may pass between the drawer boxes of the compartments.

In addition, a separation wall 13 is provided in the freezing compartment 12 (referring to FIGS. 4 and 5). The separation wall 13 is a wall built for dividing the freezing compartment 12 into left and right spaces, and is configured to be vertically erected at a center portion in the freezing compartment 12.

The two freezing compartment doors 30*a* and 30*b* are configured to open and close the opposite spaces in the freezing compartment 12 divided by the separation wall 13, respectively. That is, one freezing compartment door 30*a* (hereinbelow, the door refers to "first freezing compartment door") is configured to open and close one side space in the freezing compartment (the left side space viewed from the front). Further, another freezing compartment door 30*b* (hereinbelow, the door refers to "second freezing compartment door") is configured to open and close another side space in the freezing compartment (the right-side space viewed from the front).

In addition, storage boxes in which the object to be stored may be provided in inner surfaces of the two freezing compartment doors 30*a* and 30*b*.

Further, the evaporator 40 is provided in the cabinet 10.

As shown in FIG. 6. The evaporator 40 may be located in the rear side (the rear side in the freezing compartment) in the inner casing 10*c* for the freezing compartment. In more detail, the evaporator 40 may be located above a machine chamber 15.

The machine chamber 15 is provided in a lower rear portion outside the inner casing 10*c* for the freezing compartment and provides a space in which a compressor and a condenser are installed.

The lower rear portion in the freezing compartment 12 has a freezing space that is narrower than an upper rear portion in the freezing compartment 12 by the size of the machine chamber 15. That is, the upper portion in the freezing compartment 12 is formed by protruding rearward more than the lower portion in the freezing compartment 12, and the evaporator 40 is located in the upper rear port ion in the freezing compartment 12.

Further, a recovery duct 53 for the refrigerating compartment is provided in the cabinet 10.

The recovery duct 53 for the refrigerating compartment is provided to recover the cool air flowing in the refrigerating compartment 11 toward a cool air inlet side of the evaporator 40.

Figure 9:
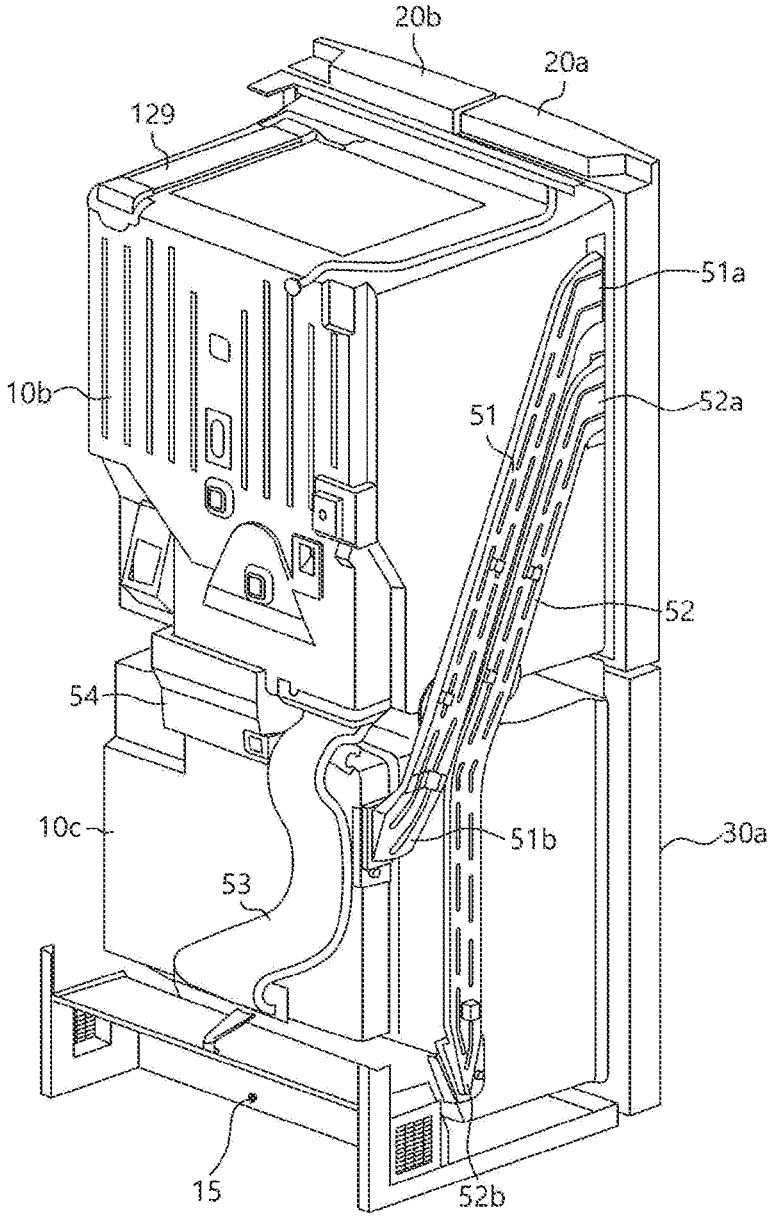
FIG. 9 is a perspective view from the rear of the refrigerator, the view showing a state in which an outer casing is removed for showing an installation structure of a cool air duct for the ice-making compartment, a recovery duct for the ice-making compartment, a connection duct, and a recovery duct for a refrigerating compartment.
Figure 10:
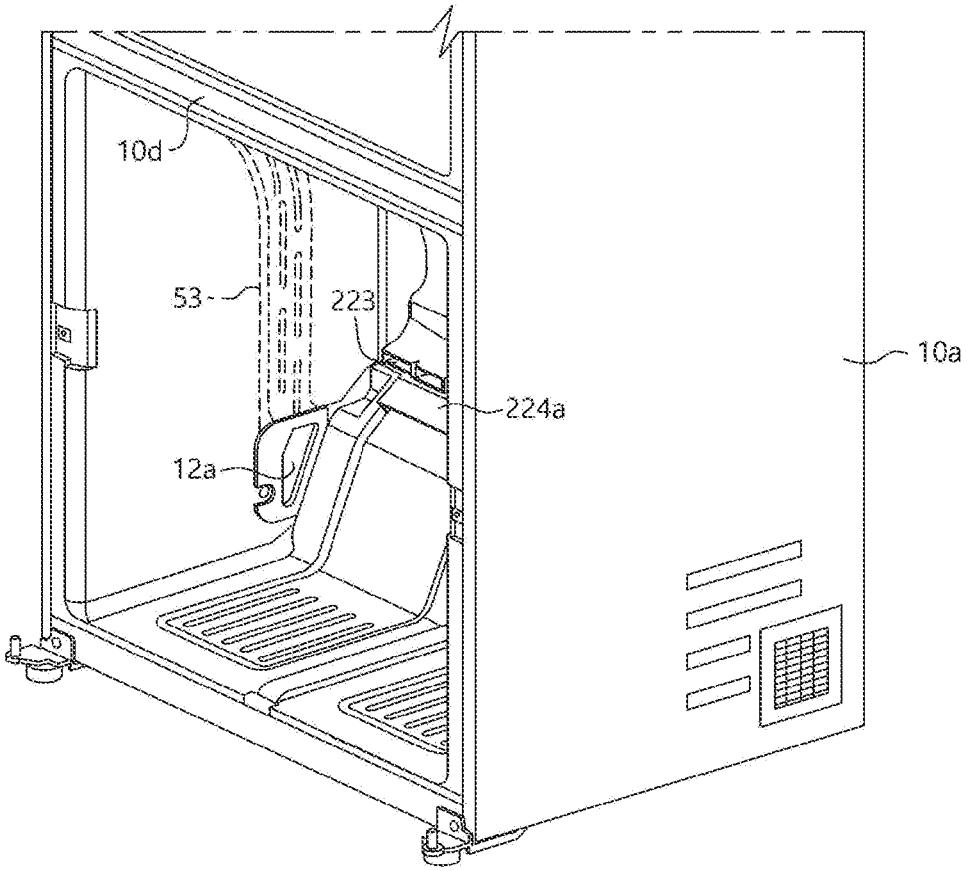
FIG. 10 is a main-part perspective view showing a state of either side wall surface in a freezing compartment for showing a connection structure of the recovery duct for the ice-making compartment of the refrigerator according to the embodiment of the present disclosure.

A first end of the recovery duct 53 for the refrigerating compartment is configured to be connected to a lower end of a rear surface of the inner casing 10*b* for the refrigerating compartment constituting the cabinet 10. A second end of the recovery duct 53 for the refrigerating compartment is configured to be connected to the cool air inlet side (a lower portion of the evaporator) of the evaporator 40 of a rear surface of the inner casing 10*c* for the freezing compartment constituting the cabinet 10. The structure is as shown in FIGS. 9 and 11.

Figure 11:
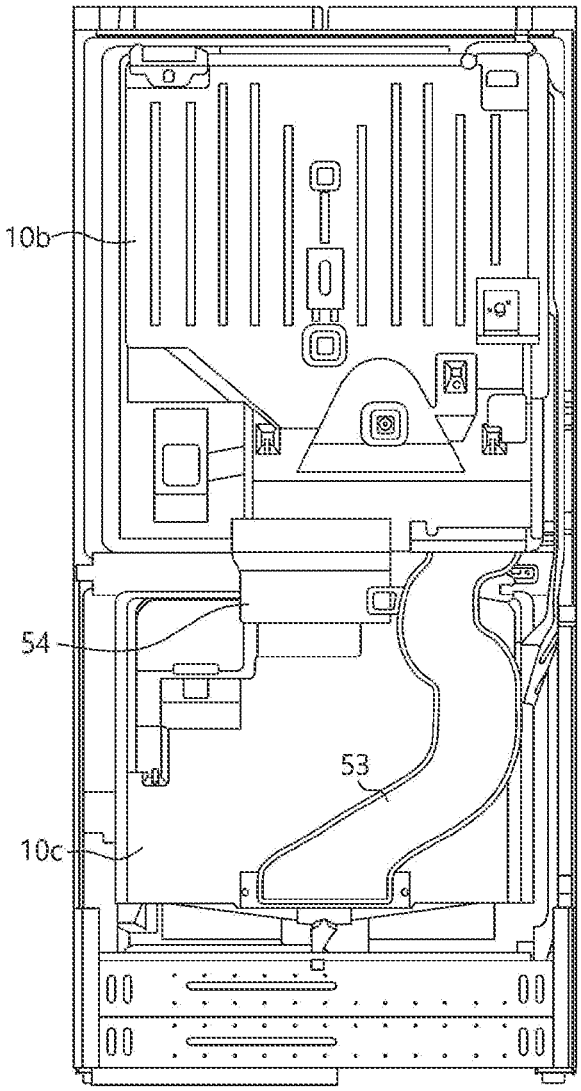
FIG. 11 is a rear view showing the refrigerator according to the embodiment of the present disclosure in a state in which the outer casing is removed for showing an installation structure of the connection duct and the recovery duct for the refrigerating compartment.

The first end of the recovery duct 53 for the refrigerating compartment is configured to be connected to a side portion of a connection passage 54 (referring to FIG. 11). The connection passage 54 is a configuration provided in the cabinet 10 to provide cool air blown from the freezing compartment side grille fan assembly 2 to the refrigerating compartment side grille fan assembly 1.

The connection passage 54 may be integrally formed in the refrigerating compartment side grille fan assembly 1 or integrally formed in the freezing compartment side grille fan assembly 2. The connection passage 54 may be formed separately from the cabinet 10 and the two grille fan assemblies 1 and 2 and then may be connected to the two grille fan assemblies 1 and 2.

In the embodiment of the present disclosure, the connection passage 54 is a structure separately formed from the two grille fan assemblies 1 and 2 and having opposite ends connected to the two grille fan assemblies 1 and 2.

The two grille fan assemblies 1 and 2 include the refrigerating compartment side grille fan assembly 1 provided in the refrigerating compartment 11, and the freezing compartment side grille fan assembly 2 provided in the freezing compartment 12.

In particular, the refrigerating compartment side grille fan assembly 1 is configured to receive cool air from the freezing compartment side grille fan assembly 2 and to supply the cool air into the refrigerating compartment 11. The freezing compartment side grille fan assembly 2 is configured to receive cool air heat-exchanged by passing through the evaporator 40, and to supply the cool air into the freezing compartment 12 and the ice-making compartment 21 or to supply the cool air to the refrigerating compartment side grille fan assembly 1.

The freezing compartment side grille fan assembly 2 is provided in the front of the evaporator 40.

In the freezing compartment side grille fan assembly 2, two fan modules 230 and 240 are simultaneously provided therein and selectively supply cool air to the freezing compartment 12 and the ice-making compartment 21.

That is, the two fan modules 230 and 240 are simultaneously provided in the single freezing compartment side grille fan assembly 2, and a structure for guiding a flow of cool air blown by the two fan modules 230 and 240 allows the two fan modules 230 and 240 to be integrally formed in the freezing compartment side grille fan assembly 2.

Further, a cool air duct 51 for the ice-making compartment is provided in a gap between the outer casing 10*a* and any one side wall of the two inner casings 10*b* and 10*c* constituting the cabinet 10.

The cool air duct 51 for the ice-making compartment is a duct that guides the cool air provided from the freezing compartment side grille fan assembly 2 to be supplied to the ice-making compartment 21.

Figure 12:
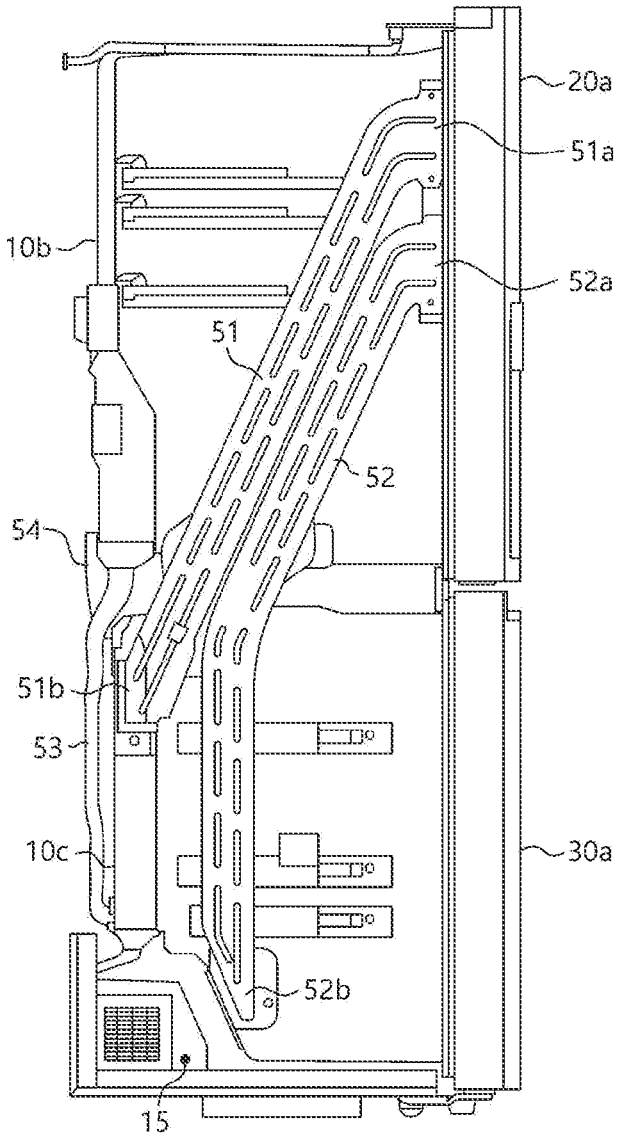
FIG. 12 is a side view showing the refrigerator according to the embodiment of the present disclosure in a state in which the outer casing is removed for showing the installation structure of the cool air duct for the ice-making compartment, the recovery duct for the ice-making compartment, the connection duct, and the recovery duct for the refrigerating compartment.
Figure 13:
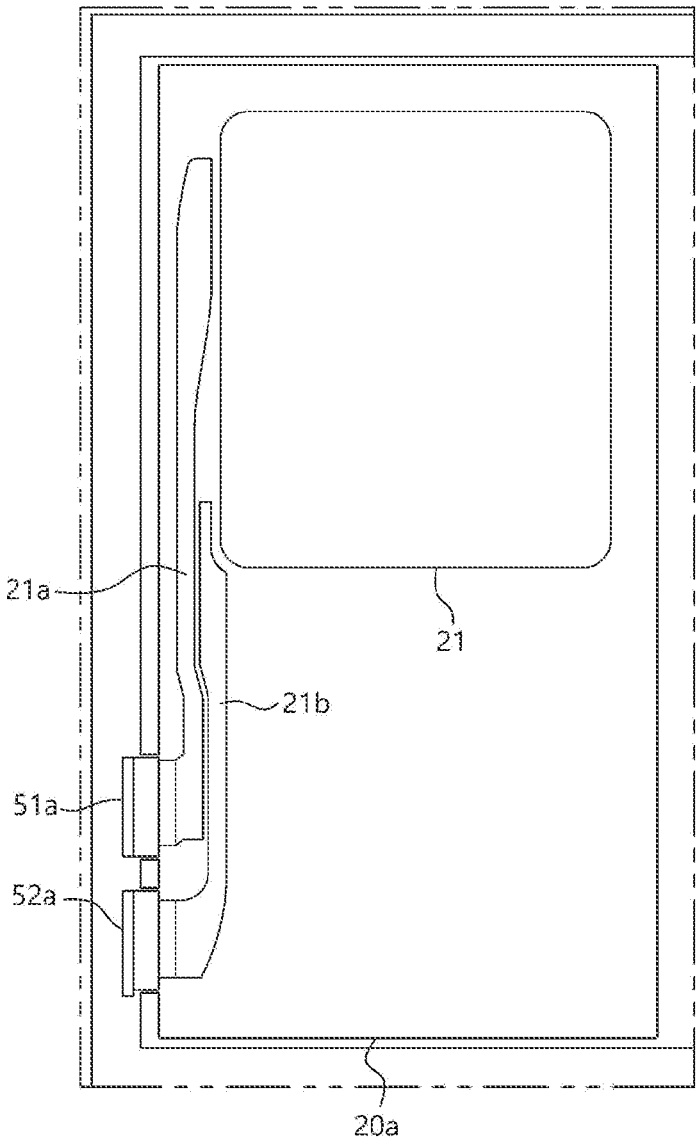
FIG. 13 is a state view schematically showing a passage structure for supply and recovery cool air to the ice-making compartment of the refrigerator according to the embodiment of the present disclosure.
Figure 14:
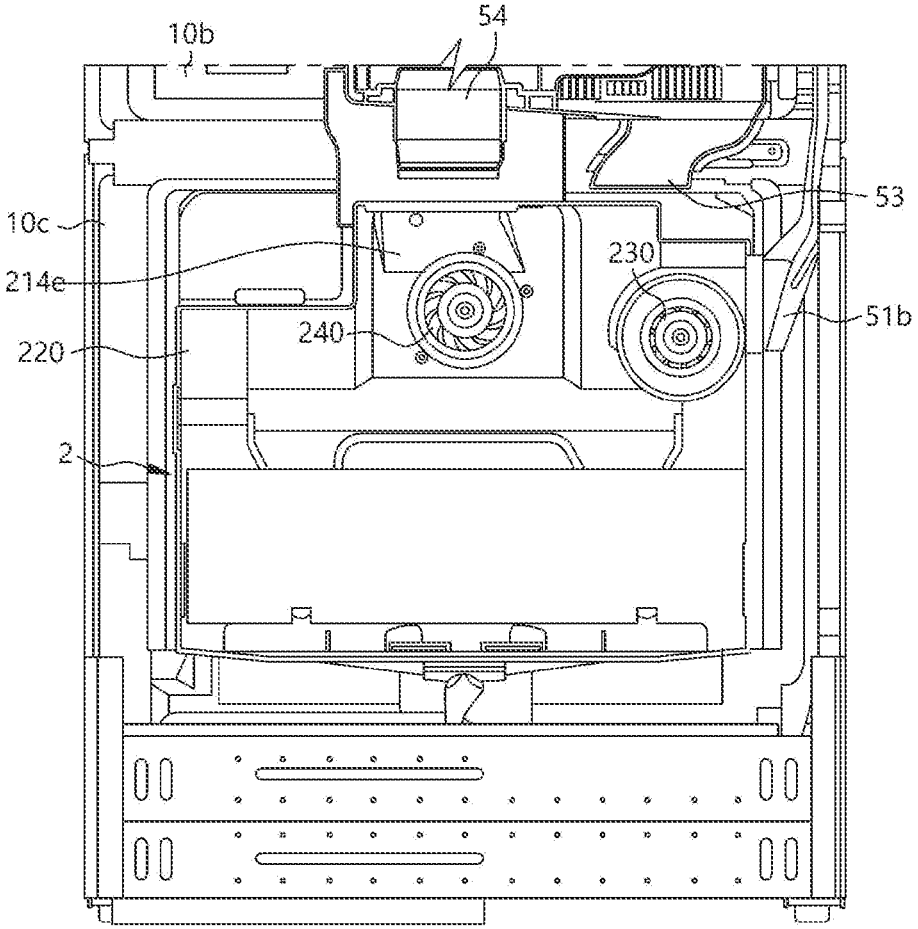
FIG. 14 is a main part view from the rear of the refrigerator in a state of removing the outer casing, the view showing a rear side of the freezing compartment of the refrigerator according to the embodiment of the present disclosure.

A first end 51*a* of the cool air duct 51 for the ice-making compartment is installed by penetrating any one side surface (a side where the refrigerating compartment door having the ice-making compartment is located, the right side in the drawing when viewed from the rear surface) of the freezing compartment side grille fan assembly 2. That is, an outlet from which the cool air of the cool air passage 213 for the ice-making compartment flows out is configured to be opened toward any one side portion between a grille panel 220 and a shroud 210 constituting the freezing compartment side grille fan assembly 2, so that the cool air blown by an ice-making fan module 230 may flow smoothly without sudden change of direction. The above structure is as shown in FIGS. 9 and 12.

In addition, a second end 51*b* of the cool air duct 51 for the ice-making compartment is configured to penetrate a side wall of the inner casing 10*b* for the refrigerating compartment to be exposed into the refrigerating compartment 11.

The second end 51*b* of the cool air duct 51 for the ice-making compartment is configured to supply the cool air to a supply guide duct 21*a* while matching with the supply guide duct 21*a* provided in the first refrigerating compartment door 20*a*, when the first refrigerating compartment door 20*a* having the ice-making compartment 21 is operated to be closed. The supply guide duct 21*a* is formed to be extended to the ice-making compartment 21 and configured to supply the cool air to the ice-making compartment 21.

In addition, a recovery guide duct 21*b* is provided in the first refrigerating compartment door 20*a*. A first end of the recovery guide duct 21*b* is connected to the ice-making compartment 21 and a second end thereof is formed to be extended to a lower portion of a side wall of the first refrigerating compartment door 20*a*, thereby guiding a recovery flow of the cool air passing through the ice-making compartment 21. The above structure is as shown in FIG. 12.

Further, a recovery duct 52 for the ice-making compartment is provided in a gap between the outer casing 10*a* and any one side wall of the inner casing 10*b*, 10*c* of the cabinet 10.

The recovery duct 52 for the ice-making compartment is a duct for guiding the cool air passing through the ice-making compartment 21 to be recovered to the freezing compartment 12.

A first end 52*a* of the recovery duct 52 for the ice-making compartment is configured to penetrate the side wall of the inner casing 10*b* for the refrigerating compartment to be exposed into the refrigerating compartment 11. The first end 52*a* of the recovery duct 52 for the ice-making compartment is configured to match with the second end of the recovery guide duct 21*b* when the first refrigerating compartment door 20*a* having the ice-making compartment 21 is operated to be closed. The above structure is as shown in FIGS. 2 and 12.

In addition, a second end 52*b* of the recovery duct 52 for the ice-making compartment is configured to pass through a penetration hole 12*a* (referring to FIGS. 6 and 10) provided in a side wall of the inner casing 10*c* for the freezing compartment to be exposed into the freezing compartment 12.

The second end 52*b* of the recovery duct 52 for the ice-making compartment is configured to be located at the rearmost side of a space in the lower compartment in the freezing compartment 12.

In particular, it is preferable that the penetration hole 12*a* where the second end 52*b* of the recovery duct 52 for the ice-making compartment is located is located as close to a cool air suction side (a side where cool air recovered from the freezing compartment to the evaporator is suctioned) of the freezing compartment side grille fan assembly 2 as possible. That is, the cool air recovered from the recovery duct 52 for the ice-making compartment should flow directly toward the evaporator 40 without affecting the temperature and humidity in the freezing compartment 12 as little as possible.

It is preferable that the penetration hole 12*a*, in which the second end 52*b* of the recovery duct 52 for the ice-making compartment is located, is located in parallel with a side portion of a first suction guide 224*a* provided in the freezing compartment side grille fan assembly 2 of any one side wall of the inner casing 10*c* for the freezing compartment.

In particular, the second end 52*b* (or, the penetration hole 12*a* where the second end is located) of the recovery duct 52 for the ice-making compartment is formed in a triangular structure that gradually narrows toward a lower port ion thereof, and the second end 52*b* being configured to be opened to the lower compartment in the freezing compartment 12.

That is, when a cool air discharge portion (or, the penetration hole) of the recovery duct 52 for the ice-making compartment is formed to have a long structure in the transverse direction, the temperature in the freezing compartment 12 may be affected by the structure. However, as shown in the embodiment of the present disclosure, the cool air discharge portion (or, penetration hole) of the triangular structure of the recovery duct 52 for the ice-making compartment has a vertically long structure while considering the shape of the machine chamber 15, so that the effect on the temperature in the freezing compartment 12 may be minimal.

Further, the refrigerating compartment side grille fan assembly 1 of the refrigerator is configured to supply the cool air, which is provided from the freezing compartment side grille fan assembly 2 through the connection passage 54, to each portion in the refrigerating compartment 11. The freezing compartment side grille fan assembly 2 is configured to selectively supply the cool air, which is heat-exchanged by passing through the evaporator 40, to the refrigerating compartment 11, the freezing compartment 12, or the ice-making compartment 21.

The connection passage 54 is configured to connect the center of a lower portion of the refrigerating compartment side grille fan assembly 1 to the center of an upper portion of the freezing compartment side grille fan assembly 2. The above structure is as shown in FIGS. 9 and 11.

The connection passage 54 may be formed in a block in which a passage is provided.

Although not shown in the drawings, the connection passage 54 may be formed in a hollow tube body (duct), or may be formed in a flexible material such as a hose.

In addition, the passage gate 60 is provided in at least one portion of the refrigerating compartment side grille fan assembly 1 and the connection passage 54.

The passage gate 60 is a configuration that is provided to selectively block the cool air introduced through the connection passage 54 from the cool air passage 214 for the freezing compartment. That is, by the passage gate 60, the selective cool air supply may be performed in the cool air passage 121 for the refrigerating compartment of the refrigerating compartment side grille fan assembly 1.

The passage gate 60 may be provided in a cool air inlet side of the cool air passage 121 for the refrigerating compartment. That is, since the passage gate 60 is provided in the refrigerating compartment side grille fan assembly 1, assembly and maintenance thereof may be performed easily.

Figure 8:
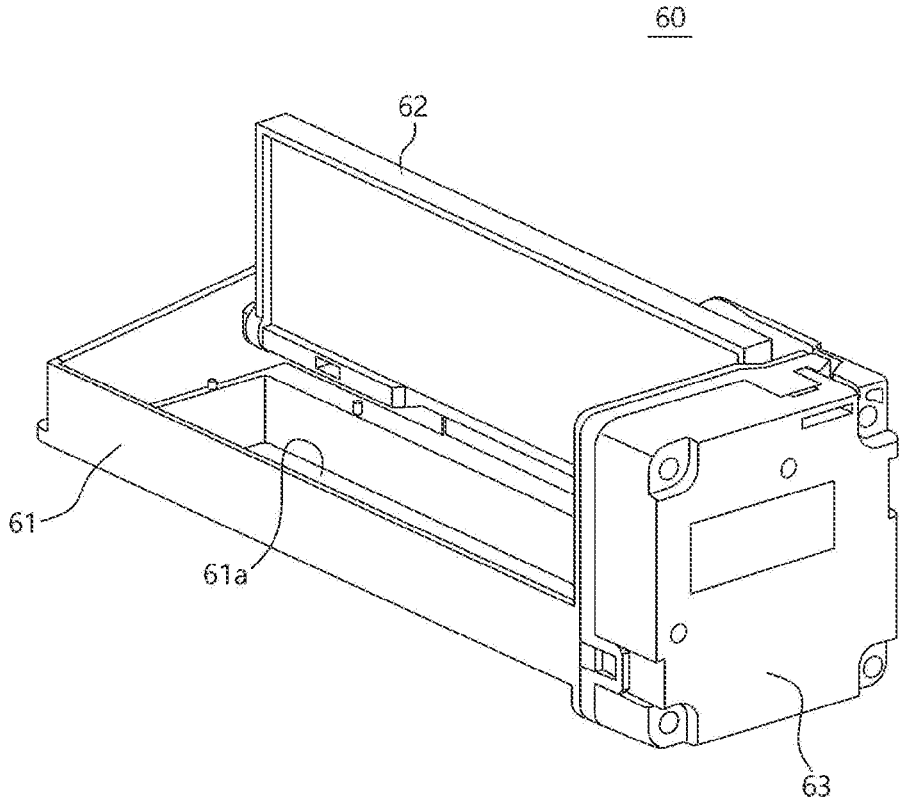
FIG. 8 is a perspective view showing an example of a passage gate of the refrigerator according to the embodiment of the present disclosure.

As shown in FIG. 8, the passage gate 60 includes a damper casing 61, an opening and closing damper 62, and a damper operation part 63.

The damper casing 61 is provided in the cool air passage 121 for the refrigerating compartment and is formed in a rectangular frame structure in which a through hole 61*a* is provided. The opening and closing damper 62 is configured to be provided in the damper casing 61 and to open and close the through hole 61*a*. The damper operation part 63 is configured to operate the opening and closing damper 62.

The damper operation part 63 may be a motor, the opening and closing damper 62 may be formed in a plate that rotates while being coupled to the motor by a shaft to close or open the through hole 61*a*.

Although not shown in the drawings, the passage gate 60 may be configured to forcibly close or open a passage through which the cool air passes by a solenoid or cylinder, or may be configured in various structures other than that.

Meanwhile, according to the embodiment of the present disclosure, the improved refrigerating compartment side grille fan assembly 1 is provided in the refrigerator.

That is, the conventional refrigerating compartment side grille fan assembly is configured to supply a uniform amount of cool air to all of left and right, and upper and lower spaces in the refrigerating compartment 11. Accordingly, in the case of the refrigerator having the ice-making compartment 21 provided in the refrigerating compartment door 20*a*, there is a problem that the temperature in each portion in the refrigerating compartment 11 is not constant, and the temperature has wide variation.

Accordingly, in the refrigerator according to the embodiment of the present disclosure, the refrigerating compartment side grille fan assembly 1 is configured to supply more cool air to the space having the second refrigerating compartment door 20*b* than the space having the first refrigerating compartment door 20*a* of the spaces of the opposite sides in the refrigerating compartment 11.

Considering that the ice-making compartment 21 is provided in the first refrigerating compartment door 20*a* and cool air supplied to the ice-making compartment 21 is cool air supplied from the freezing compartment 12 having a lower temperature than cool air in the refrigerating compartment 11, the ambient temperature in the ice-making compartment 21 has also a lower temperature than the temperature in the refrigerating compartment 11. Therefore, the side where the ice-making compartment 21 is located is maintained in a lower temperature range that other portions even when the cool air of the refrigerating compartment 11 is not sufficiently supplied to the side. Considering the above structure, the refrigerator is configured to supply a larger amount of cool air to the side where the second refrigerating compartment door 20*b* is located, so that the entire port ion of the refrigerating compartment is maintained at a uniform temperature.

Since the one space of the refrigerating compartment 11 is smaller than the another space thereof by the size of the ice-making compartment 21, even when the amount of cool air supplied to the one space is less than the amount of cool air supplied to the another space, refrigeration of the object to be stored may be performed smoothly.

Hereinbelow, according to the embodiment of the present disclosure, the embodiment with respect to detailed structure of the refrigerating compartment side grille fan assembly 1 will be described with respect to FIGS. 15 to 25.

Figure 15:
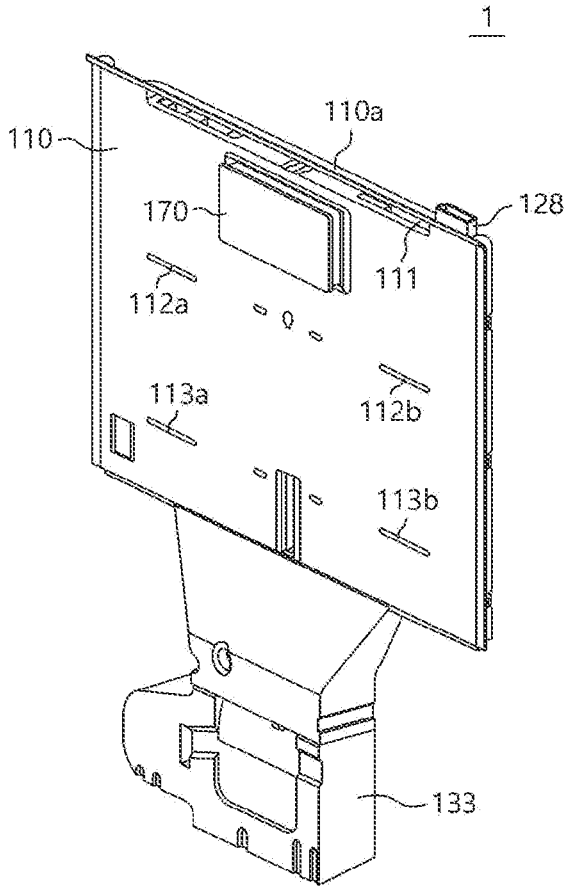
FIG. 15 is a perspective view from the front of the refrigerator, the view showing a refrigerating compartment side grille fan assembly of the refrigerator according to the embodiment of the present disclosure.
Figure 16:
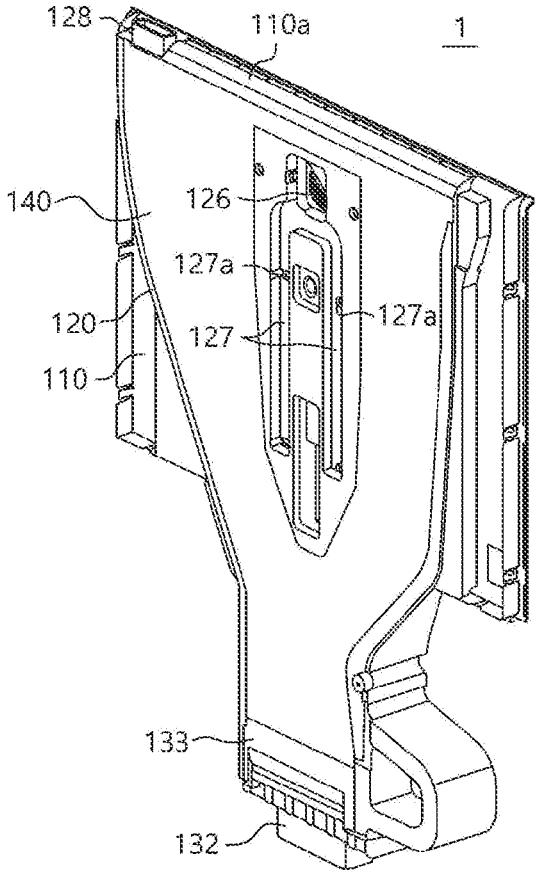
FIG. 16 is a perspective view from the rear of the refrigerator, the view showing the refrigerating compartment side grille fan assembly of the refrigerator according to the embodiment of the present disclosure.

FIG. 15 is a perspective view from the front of the refrigerator showing the refrigerating compartment side grille fan assembly of the refrigerator according to the embodiment of the present disclosure. FIG. 16 is a perspective view from the rear off the refrigerator showing the refrigerating compartment side grille fan assembly of the refrigerator according to the embodiment of the present disclosure.

Figure 17:
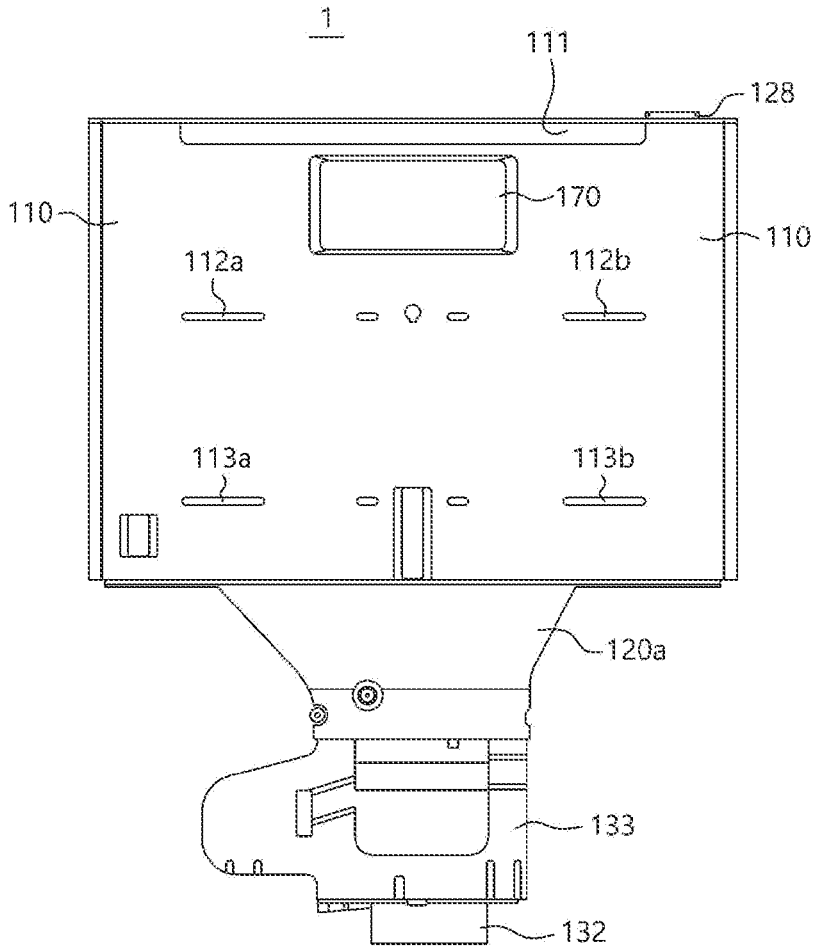
FIG. 17 is a front view showing the refrigerating compartment side grille fan assembly of the refrigerator according to the embodiment of the present disclosure.
Figure 18:
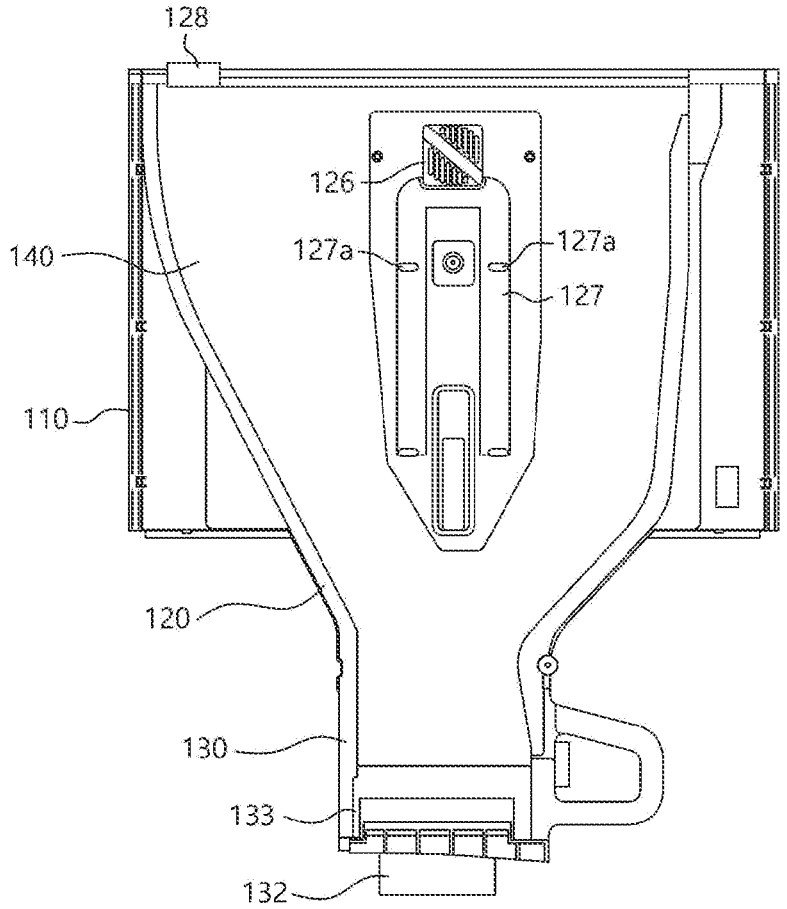
FIG. 18 is a rear view showing the refrigerating compartment side grille fan assembly of the refrigerator according to the embodiment of the present disclosure.

FIG. 17 is a front view showing the refrigerating compartment side grille fan assembly of the refrigerator according to the embodiment of the present disclosure. FIG. 18 is a rear view showing the refrigerating compartment side grille fan assembly of the refrigerator according to the embodiment of the present disclosure.

As shown in the drawings, the refrigerating compartment side grille fan assembly 1 includes an upper grille panel 110 and a duct unit 120. Each configuration will be described below.

First, the upper grille panel 110 will be described.

The upper grille panel 110 is a portion providing a front surface of the refrigerating compartment side grille fan assembly 1.

A front surface of the upper grille panel 110 is configured as a rear wall surface in the refrigerating compartment 11 when viewed from the front of the refrigerator.

A plurality of cool air outlets 111, 112*a*, and 112*b* is formed in the upper grille panel 110 (referring to FIGS. 15 and 17).

The cool air outlets 111, 112*a*, and 112*b* include a cool air outlet 111 for an upper compartment supplying cool air to the upper compartment of the refrigerating compartment 11, and a cool air outlet 112*a*. 112*b* for a middle compartment supplying cool air to the middle compartment of the refrigerating compartment 11.

The cool air outlet 111 for the upper compartment is configured to guide cool air to be discharged along an upper wall surface of the refrigerating compartment 11, and is formed in an upper end of the upper grille panel 110.

In particular, a cool air discharge guide 110*a* that guides a flow direction of cool air discharged through the cool air out let 111 for the upper compartment is provided in the upper end of the upper grille panel 110. The cool air discharge guide 110*a* is formed to be inclined or rounded forward as the cool air discharge guide 110*a* goes upward (referring to FIGS. 16 and 19).

The cool air outlet 112*a*, 112*b* for the middle compartment are configured as two cool air outlets 112*a* and 112*b*. Each of the cool air outlets 112*a* and 112*b* are configured to be symmetrically located on opposite sides based on a center port ion of the refrigerating compartment 11.

In the cool air out lets 112*a* and 112*b* for the middle compartment, one cool air outlet 112*a* for the middle compartment (hereinbelow, which refers to "first cool air outlet for the middle compartment") is located on a side facing the first refrigerating compartment door 20*a* where the ice-making compartment 21 is located. The remaining cool air outlet 112*b* for the middle compartment (hereinbelow, which refers to "second cool air outlet for the middle compartment") is located in a side facing the second refrigerating compartment door 20*b* where the ice-making compartment 21 is not located.

The two cool air outlets 112*a* and 112*b* for the middle compartment are formed identically to each other.

Although not shown in the drawings, transverse widths of the two cool air outlets 112*a* and 112*b* for the middle compartment may be formed to be different from each other. However, when the transverse widths of the two cool air outlets 112*a* and 112*b* for the middle compartment are different from each other, complaints of a user may be caused. That is, when the refrigerating compartment side grille fan assembly 1 forming the rear wall surface of the refrigerating compartment 11 is formed in an asymmetric shape that is not bilateral symmetry, the user may suspect a product defect due to the asymmetric shape or may be dissatisfied with the design.

Considering the above problem, it is preferable that the cool air outlets 112*a* and 112*b* for the middle compartment have the same shape.

In addition, the upper grille panel 110 may have unused cool air outlets 113*a* and 113*b*.

The unused cool air outlets 113*a* and 113*b* are cool air outlets with closed rear surfaces so that cool air discharge is not actually performed. The unused cool air outlets 113*a* and 113*b* are respectively located in lower portions of the cool air outlets 112*a* and 112*b* for the middle compartment.

Hereinbelow, the duct unit 120 will be described.

The duct unit 120 is a portion guiding a cool air flow and provided in a rear surface of the upper grille panel 110, as show in FIGS. 16 and 18 to 20.

The duct unit 120 is coupled in close contact with the rear surface of the upper grille panel 110, and in this case, a coupling method thereof may include screw coupling, bonding, press fitting coupling, welding, etc.

Figure 19:
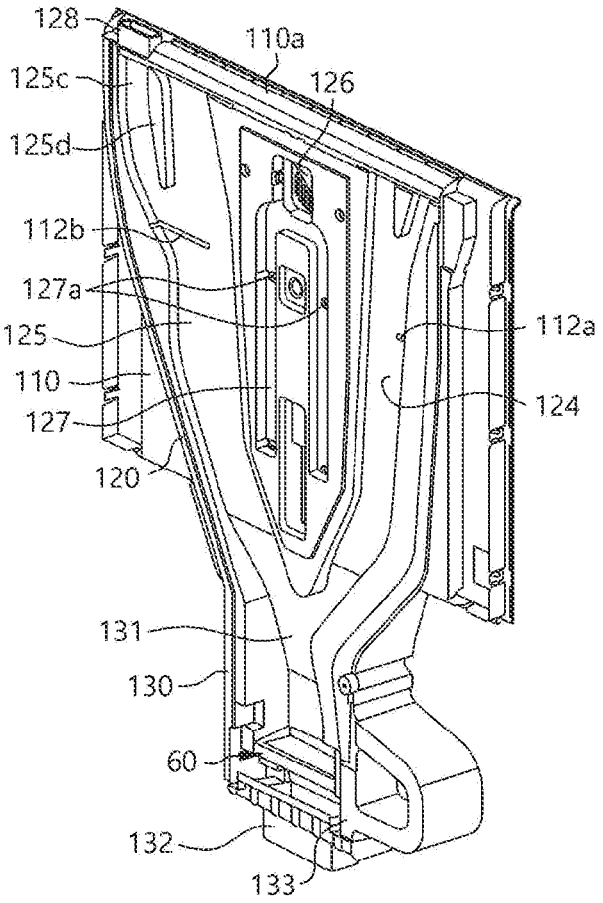
FIG. 19 is a perspective view from the rear of the refrigerator, the view showing a state in which a blocking plate of the refrigerating compartment side grille fan assembly of the refrigerator according to the embodiment of the present disclosure is removed.
Figure 20:
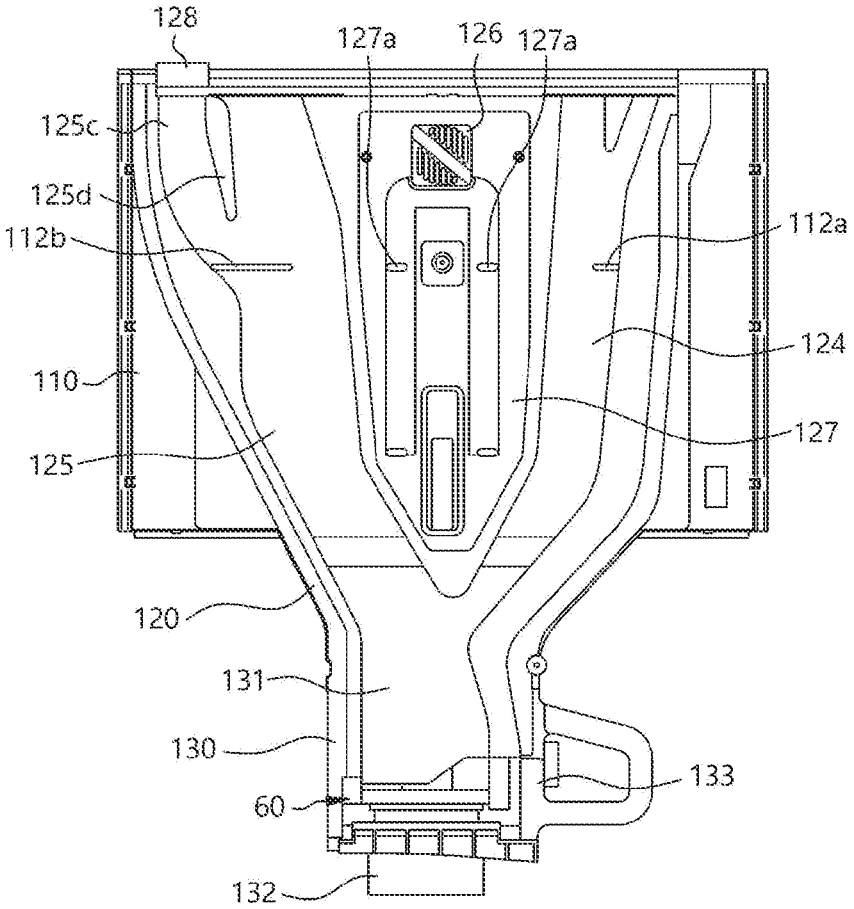
FIG. 20 is a rear view showing the state in which the blocking plate of the refrigerating compartment side grille fan assembly of the refrigerator according to the embodiment of the present disclosure is removed.
Figure 21:
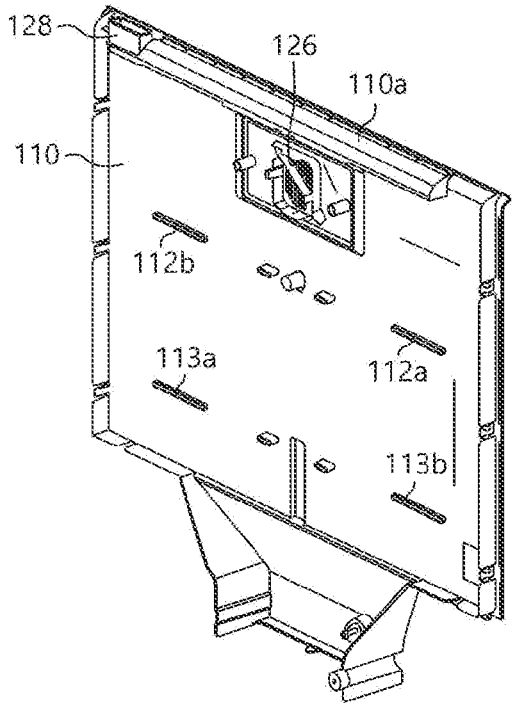
FIG. 21 is a perspective view from the front of the refrigerator, the view showing an upper grille panel of the refrigerating compartment side grille fan assembly of the refrigerator according to the embodiment of the present disclosure.

Further, cool air inlets 122*a* and 122*b* for the middle compartment are formed by penetrating from the front to the rear of opposite sides of the duct unit 120 (referring to FIGS. 19 and 20).

The two cool air inlets 122*a* and 122*b* for the middle compartment includes a first cool air inlet 122*a* for the middle compartment and a second cool air inlet 122*b* for the middle compartment. The first cool air inlet 122*a* for the middle compartment is located to math with the first cool air outlet 112*a* for the middle compartment of the upper grille panel 110 and the second cool air inlet 122*b* for the middle compartment is located to match with the second cool air outlet 112*b* for the middle compartment of the upper grille panel 110.

The two cool air inlets 122*a* and 122*b* for the middle compartment may be formed in the same size as the cool air outlets 112*a* and 112*b* for the middle compartment or different therefrom.

Further, the first cool air passage 124 for the refrigerating compartment and a second cool air passage 125 for the refrigerating compartment are formed by recessing a rear surface of the duct unit 120.

The two cool air passages 124 and 125 for the refrigerating compartment are provided to guide cool air provided from a lower end of the duct unit 120 to flow to an upper end thereof.

The first cool air passage 124 for the refrigerating compartment is a passage that is formed in one side of the refrigerating compartment, the side facing the first refrigerating compartment door 20*a* having the ice-making compartment 21 on the basis with the center of the duct unit 120

(right side in the rear view in FIG. 20). The second cool air passage 125 for the refrigerating compartment is a passage that is formed in another side of the refrigerating compartment, the side facing the second refrigerating compartment door 20*b* without the ice-making compartment 21 (left side in the rear view in FIG. 20).

An upper end of the first cool air passage 124 for the refrigerating compartment penetrates an upper surface of the duct unit 120 to be open upward. The upper end of the first cool air passage 124 for the refrigerating compartment may be located to match with an end portion of either side of the cool air outlet 111 for the upper compartment of the upper grille panel 110.

In addition, the first cool air passage 124 for the refrigerating compartment is configured to communicate with the first cool air outlet 112*a* for the middle compartment, and the second cool air passage 125 for the refrigerating compartment is configured to communicate with the second cool air outlet 112*b* for the middle compartment.

In particular, the first cool air passage 124 for the refrigerating compartment is configured to be partially communicate with the first cool air inlet 122*a* for the middle compartment located at the same side as the first cool air passage 124 for the refrigerating compartment. The second cool air passage 125 for the refrigerating compartment is configured to completely communicate with the second cool air inlet 122*b* for the middle compartment at the same side as the second cool air passage 125 for the refrigerating compartment. That is, a communication portion between the second cool air passage 125 for the refrigerating compartment and the second cool air outlet 112*b* for the middle compartment is formed to be larger than a communication portion between the first cool air passage 124 for the refrigerating compartment and the first cool air outlet 112*a* for the middle compartment.

As a result, the amounts of cool air supplied to the opposite spaces in the refrigerating compartment 11 are different from each other. In particular, since more cool air is supplied to one space without the ice-making compartment 21 than another space having the ice-making compartment 21, temperature deviation for each portion in the refrigerating compartment 11 may be minimized.

That is, among the opposite spaces in the refrigerating compartment 11, the space having the ice-making compartment 21 is provided to be narrower than the opposite space by the thickness of the ice-making compartment 21. In addition, the temperature in the ice-making compartment 21 is lower than the temperature in the refrigerating compartment 11. Considering the above structures, as more cool air is supplied to the space without the ice-making compartment 21 among the spaces of the opposite sides of the refrigerating compartment 11, the uniform temperature range may be provided over the entire port ion in the refrigerating compartment 11.

Meanwhile, a transverse width of the second cool air passage 125 for the refrigerating compartment may be formed to be wider than a transverse width of the first cool air passage 124 for the refrigerating compartment.

By allowing a large amount of cool air to be supplied to the second cool air passage 125 for the refrigerating compartment, more cool air may be supplied to the space without the ice-making compartment 21 among the spaces of the opposite sides in the refrigerating compartment 11 through the second cool air outlet 112*b* for the middle compartment communicating with the second cool air passage 125 for the refrigerating compartment.

Further, the lower portion of the duct unit 120 has a protrusion 130 protruding downward from a lower surface of the upper grille panel 110.

The protrusion 130 has a third cool air passage 131 for the refrigerating compartment that guides a cool air flow received from the freezing compartment side grille fan assembly 2 through the connection passage 54. Lower ends of the first cool air passage 124 for the refrigerating compartment and the second cool air passage 125 for the refrigerating compartment that are formed in the rear surface of the duct unit 120 are configured to meet the third cool air passage 131 for the refrigerating compartment of the protrusion 130.

In particular, the third cool air passage 131 for the refrigerating compartment is configured to supply more cool air to the second cool air passage 125 for the refrigerating compartment than to the first cool air passage 124 for the refrigerating compartment.

In order to achieve the above configuration, a cool air outlet side of the third cool air passage 131 for the refrigerating compartment may be formed to be inclined or rounded, so that cool air flows in a direction equal to an inclination of a cool air inlet side of the second cool air passage 125 for the refrigerating compartment.

The first cool air passage 124 for the refrigerating compartment is preferably formed to be inclined or rounded in a direction different from the third cool air passage 131 for the refrigerating compartment and the second cool air passage 125 for the refrigerating compartment.

As described above, the refrigerating compartment side grille fan assembly is configured to supply more cool air through the third cool air passage 131 for the refrigerating compartment to the second cool air passage 125 for the refrigerating compartment than to the first cool air passage 124 for the refrigerating compartment. Accordingly, more cool air may be supplied to the space (the space at the side where the ice-making compartment is not located) without the ice-making compartment in the refrigerating compartment 11.

In addition, a lower connection duct 132 may be provided in a lower end of the protrusion 130.

The lower connection duct 132 is a portion to which the connection passage 54 is connected.

The connection passage 54 may be configured to be directly connected to the third cool air passage 131 for the refrigerating compartment of the protrusion 130. However, a coupling structure for simply inserting the connection passage 54 into the third cool air passage 131 for the refrigerating compartment may be easily separated in case of vibration, external shock, or shaking of the refrigerator. Further, there is a problem of leakage of cool air because air seal is not secured, and when the coupling is firmly performed in order to prevent the above problem, there is a difficulty in separation for maintenance thereof.

Considering the above problem, it is preferable that the lower connection duct 132 is additionally provided to allow the connection passage 54 to be firmly and tightly connected to the third cool air passage 131 for the refrigerating compartment and to facilitate maintenance of the connect ion passage 54.

A first end of the lower connection duct 132 has a first end and a second end. The first and second ends are formed by protruding, so that the first end is inserted and connected to a cool air inlet side of the third cool air passage 131 for the refrigerating compartment and the second end thereof is inserted and coupled to the connection passage 54.

In particular, the lower connection duct 132 may be separably coupled to the protrusion 130 or the connection passage 54 or to all of the protrusion 130 and the connection passage 54. Whereby, the refrigerating compartment side grille fan assembly 1 may be separated from the connection passage 54. The lower connection duct 132 may be configured to be separably coupled to one port ion of the protrusion 130 or the connection passage 54.

The passage gate 60 may be provided in a cool air outlet side of the lower connection duct 132 in the inside of the third cool air passage 131 for the refrigerating compartment of the protrusion 130.

Further, an installation part 126 (referring to FIGS. 16 and 18 to 20) for installation of an air purification module 170 (referring to FIGS. 15 and 17) may be provided in the duct unit 120.

The air purification module 170 is configured to suction cool air in the refrigerating compartment 11 to remove odor components and then resupply the cool air to the refrigerating compartment 11.

Although not shown in detail, the air purification module 170 may include a suction fan and a filter. That is, the air purification module 170 may be configured to suction cool air in the refrigerating compartment by the operation of the suction fan and filter the cool air, and then resupply the filtered cool air to the refrigerating compartment 11. Accordingly, the refrigerating compartment 11 may be deodorized and various contaminants therein may be removed.

The installation part 126 is located in a center portion of the upper end of the duct unit 120 (the portion between the first cool air passage for the refrigerating compartment and the second cool air passage for the refrigerating compartment), and is formed in a hole that is open from the front to the rear so that the air purification module 170 may be mounted to the installation part 126.

In addition, a recovery passage 127 that resupplies the cool air passing through the installation part 126 to the refrigerating compartment 11 is provided in the rear surface of the duct unit 120. The recovery passage 127 has communication holes 127*a* that communicate with the middle compartment side space and a lower compartment side space in the refrigerating compartment 11.

Further, a blocking plate 140 may be provided in the rear surface of the duct unit 120.

The blocking plate 140 is provided to cover the cool air passages 124 and 125 formed in the rear surface of the duct unit 120.

In particular, the blocking plate 140 is formed of insulating material. Accordingly, heat loss due to heat exchange with outside air while cool air flows along the two cool air passages 124 and 125 for the refrigerating compartment is prevented.

The insulating material may be various material, such as Styrofoam, fiber material, wood, rubber material, synthetic resin material, etc.

Meanwhile, an upper connection duct 128 (referring to FIGS. 10 to 18) may be provided in the duct unit 120.

The upper connection duct 128 is provided to supply part of cool air, which flows upward to the upper end of the duct unit 120 along the first cool air passage 124 for the refrigerating compartment or the second cool air passage 125 for the refrigerating compartment, to other portions of the refrigerating compartment 11.

That is, as a guide duct 129 is connected to the upper connection duct 128, the cool air may be directly supplied to a portion to which the guide duct 129 is connected. The above structure is as shown in FIG. 9.

A rear end of the guide duct 129 is connected to the upper connection duct 128, and a front end thereof is connected to be exposed to the inside of the refrigerating compartment 11 through a wall surface on a front side of an upper surface of the refrigerating compartment 11.

In particular, the upper connection duct 128 may be configured to receive part of cool air from the second cool air passage 125 for the refrigerating compartment.

That is, a branched passage 125*c* is provided in the second cool air passage 125 for the refrigerating compartment, and the upper connection duct 128 is connected to a cool air outlet side of the branched passage 125*c*. The second cool air passage 125 for the refrigerating compartment may have a branched guide 125*d* for providing the branched passage 125*c*. The above structure is as shown in FIG. 16 to 18.

Further, a lower grille panel 150 (referring to FIGS. 22 to 26) may be provided in a port ion of the lower surface of the upper grille panel 110, the portion being in front of the protrusion 130.

As shown in FIG. 5, the lower grille panel 150 is configured to form a lower portion of the front wall surface of the refrigerating compartment side grille fan assembly 1, and serves to block the protrusion 130 coupled to the portion to be exposed to the refrigerating compartment 11.

A cool air recovery port 151 (referring to FIGS. 5 and 22 to 26) that is open to the inside of the refrigerating compartment 11 is provided in a lower end of the lower grille panel 150.

That is, cool air flowing in the refrigerating compartment 11 is discharged to the rear of the inner casing 10*b* for the refrigerating compartment through the cool air recovery port 151.

In the recovery duct 53 for the refrigerating compartment, a first end thereof is installed to cover a port ion of the rear surface of the lower grille panel 150 where the cool air recovery port 151 is provided, and a second end thereof is installed to be connected to the cool air inlet side of the evaporator 40.

Meanwhile, he improved freezing compartment side grille fan assembly 2 is provided in the refrigerator according to the embodiment of the present disclosure.

The freezing compartment side grille fan assembly 2 includes a cool air passage 213 for the ice-making compartment and a cool air passage 214 for the freezing compartment that guide respective flows of cool air by the operations of the fan modules 230 and 240. The two cool air passages 213 and 214 are configured to share cool air with each other, and the cool air passage 214 for the freezing compartment is configured to supply cool air to the refrigerating compartment side grille fan assembly 1 while the connection passage 54 is connected thereto.

Hereinbelow, the embodiment with respect to a detailed structure of the freezing compartment side grille fan assembly 2 will be described in detail with reference to FIGS. 26 to 35.

Figure 26:
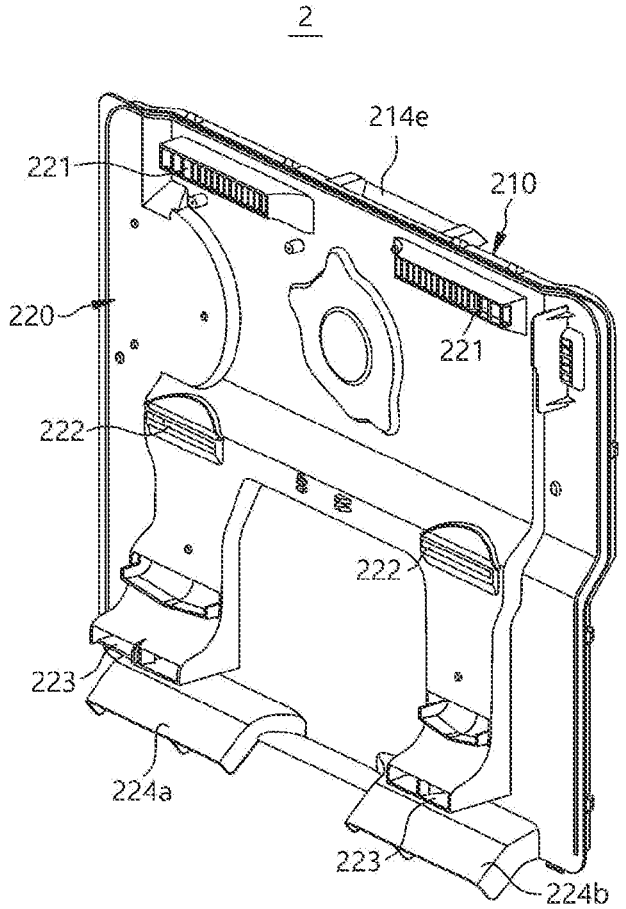
FIG. 26 is a perspective view from the front of the refrigerator, the view showing a freezing compartment side grille fan assembly of the refrigerator according to the embodiment of the present disclosure.
Figure 27:
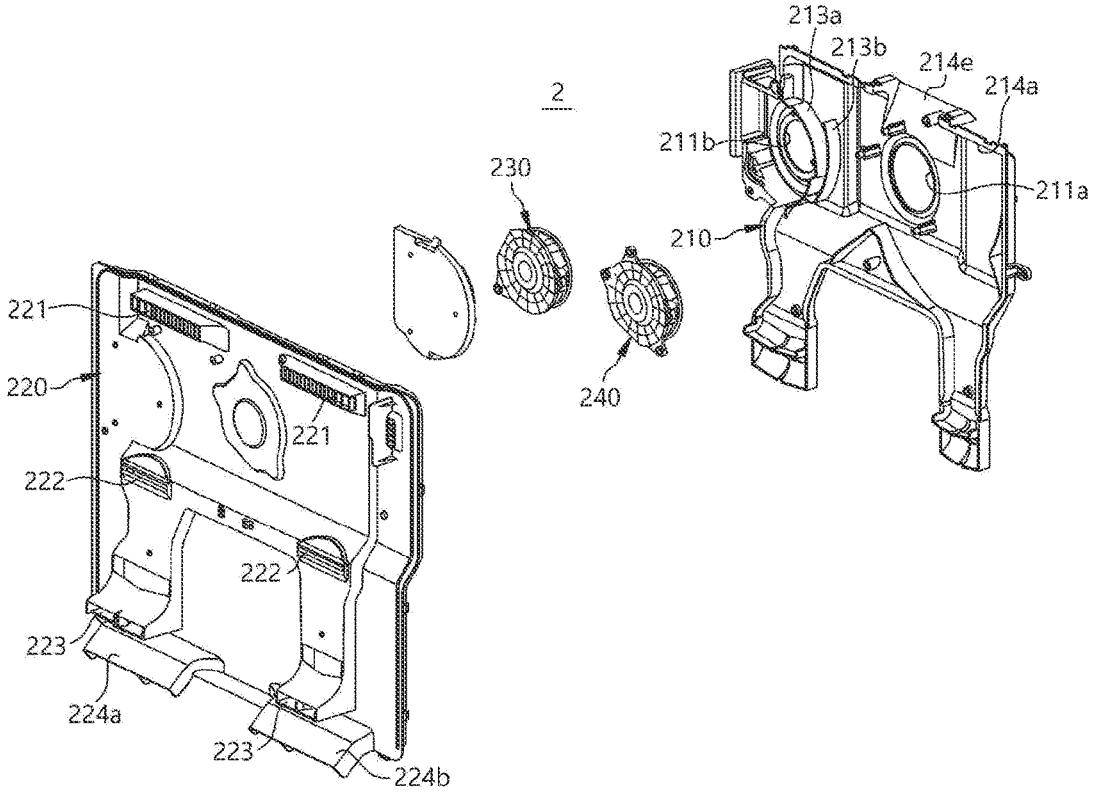
FIG. 27 is an exploded-perspective view from the front of the refrigerator, the view showing the freezing compartment side grille fan assembly of the refrigerator according to the embodiment of the present disclosure.
Figure 28:
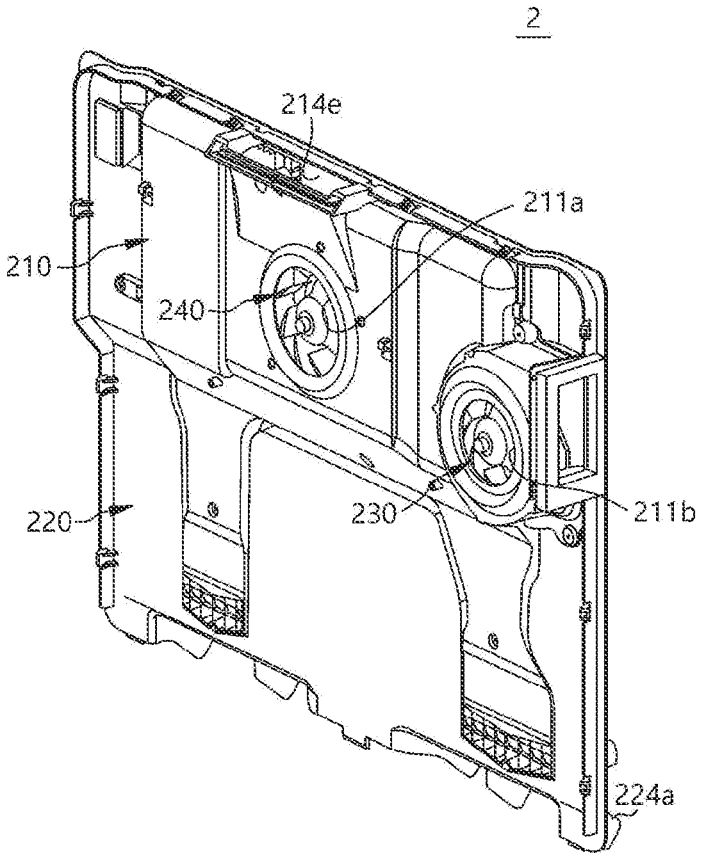
FIG. 28 is a perspective view from the rear of the refrigerator, the view showing the freezing compartment side grille fan assembly of the refrigerator according to the embodiment of the present disclosure.
Figure 29:
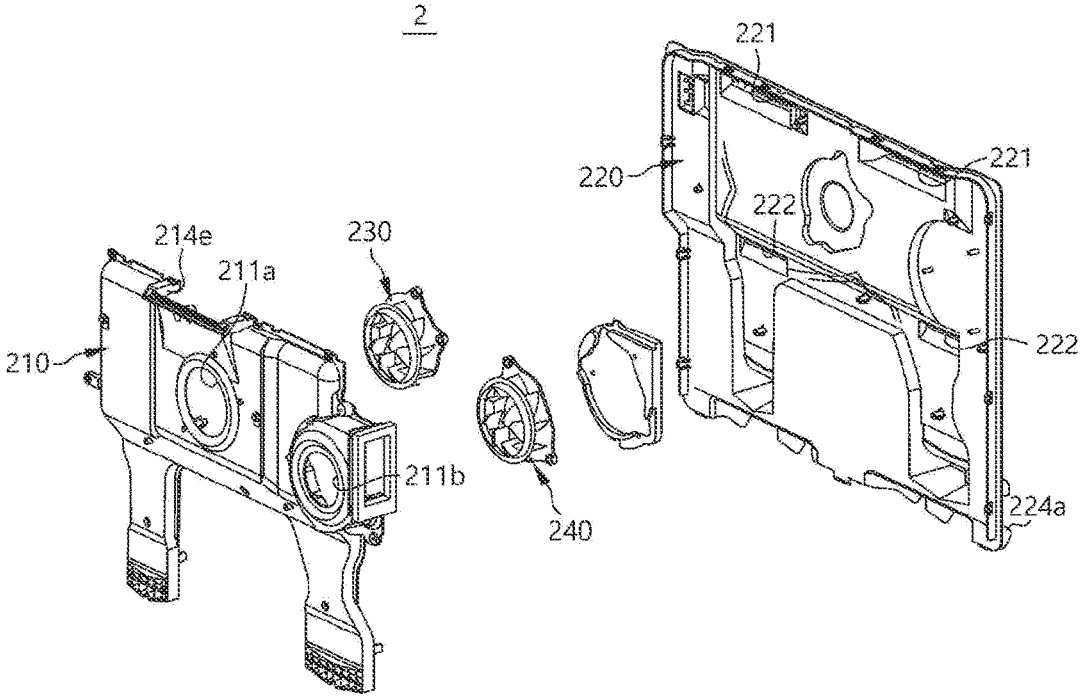
FIG. 29 is an exploded-perspective view from the rear of the refrigerator, the view showing the freezing compartment side grille fan assembly of the refrigerator according to the embodiment of the present disclosure.

FIG. 26 is a perspective view from the front of the refrigerator, the view showing a freezing compartment side grille fan assembly of the refrigerator according to the embodiment of the present disclosure. FIG. 27 is an exploded-perspective view from the front of the refrigerator, the view showing the freezing compartment side grille fan assembly of the refrigerator according to the embodiment of the present disclosure. FIG. 28 is a perspective view from the rear of the refrigerator, the view showing the freezing compartment side grille fan assembly of the refrigerator according to the embodiment of the present disclosure. FIG. 29 is an exploded-perspective view from the rear of the refrigerator, the view showing the freezing compartment side grille fan assembly of the refrigerator according to the embodiment of the present disclosure.

Figure 30:
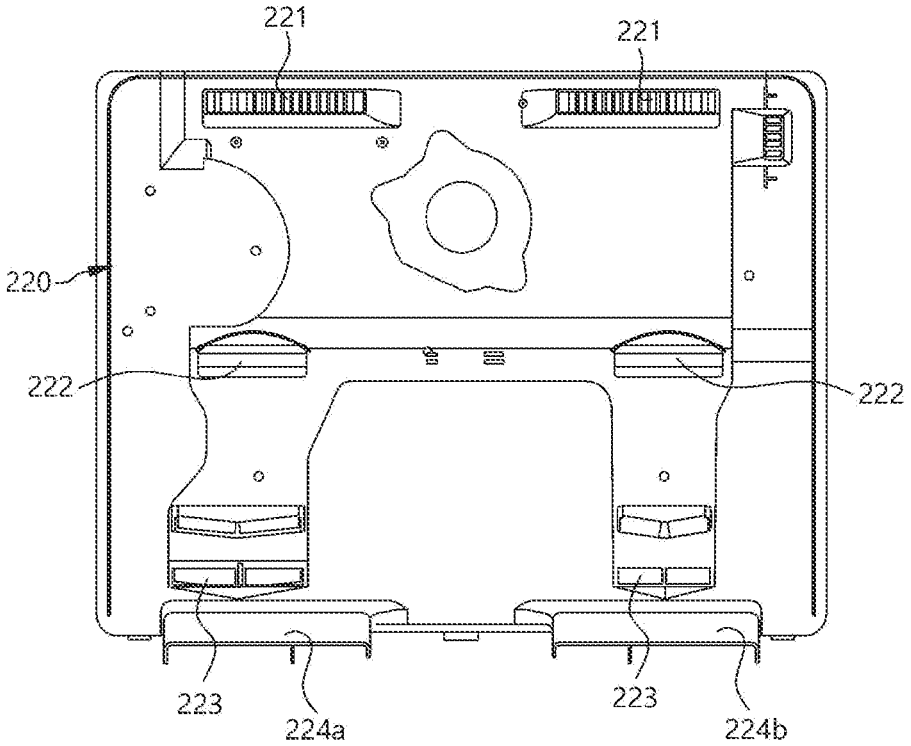
FIG. 30 is a front view showing the freezing compartment side grille fan assembly of the refrigerator according to the embodiment of the present disclosure.
Figure 31:
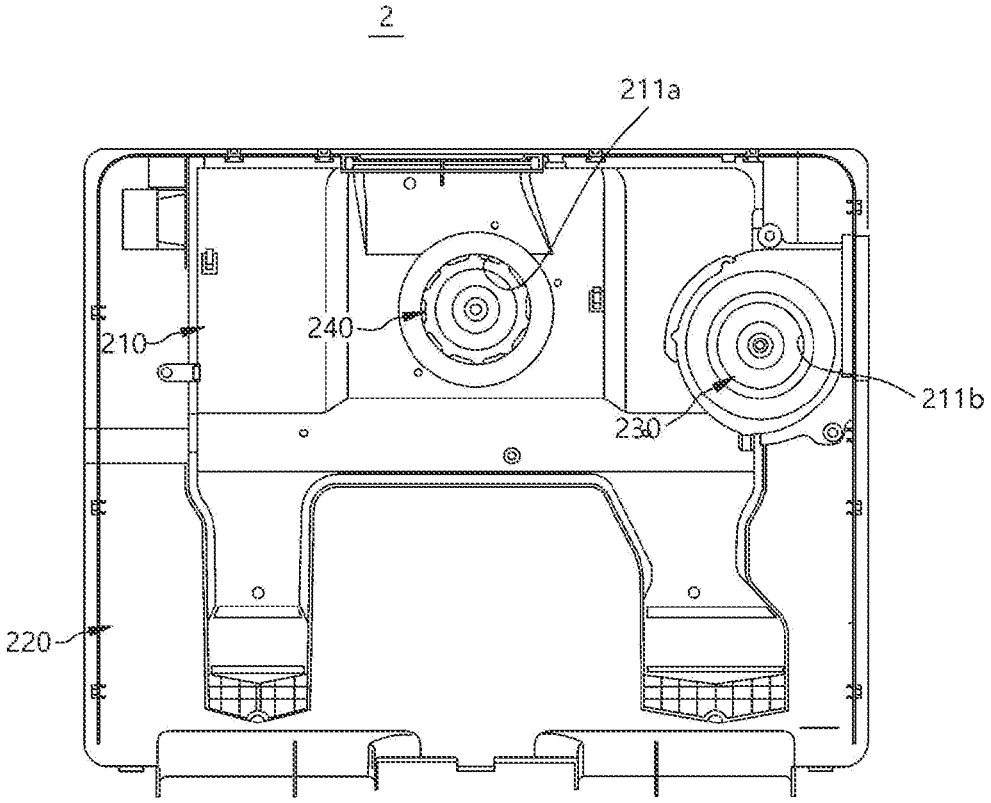
FIG. 31 is a rear view showing the freezing compartment side grille fan assembly of the refrigerator according to the embodiment of the present disclosure.
Figure 32:
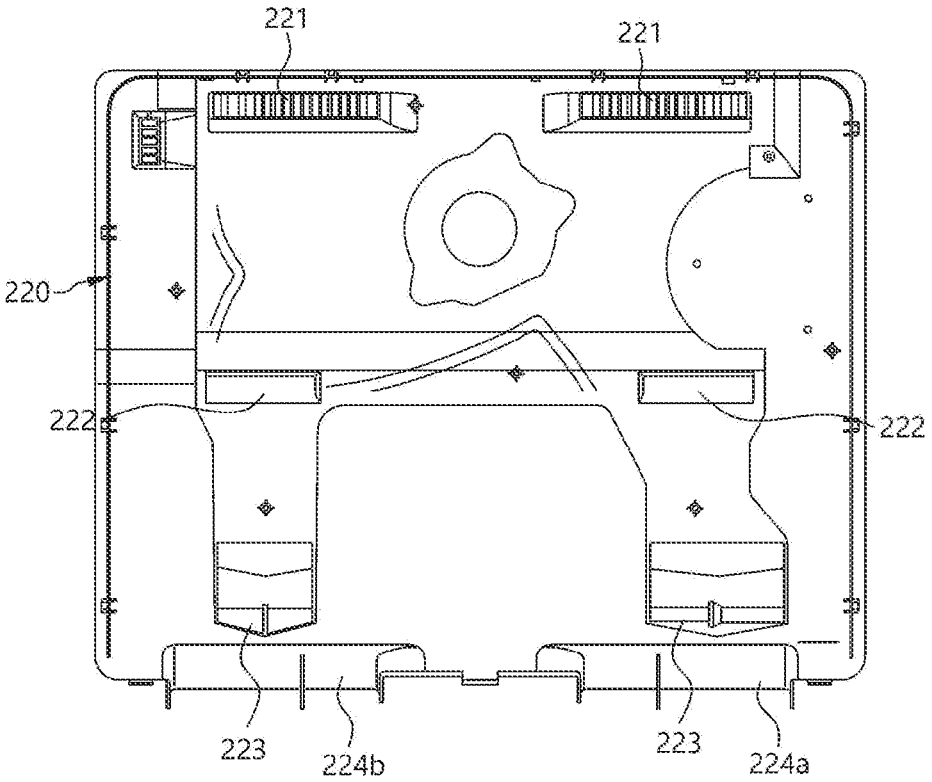
FIG. 32 is a rear view showing a grille fan of the freezing compartment side grille fan assembly of the refrigerator according to the embodiment of the present disclosure.
Figure 33:
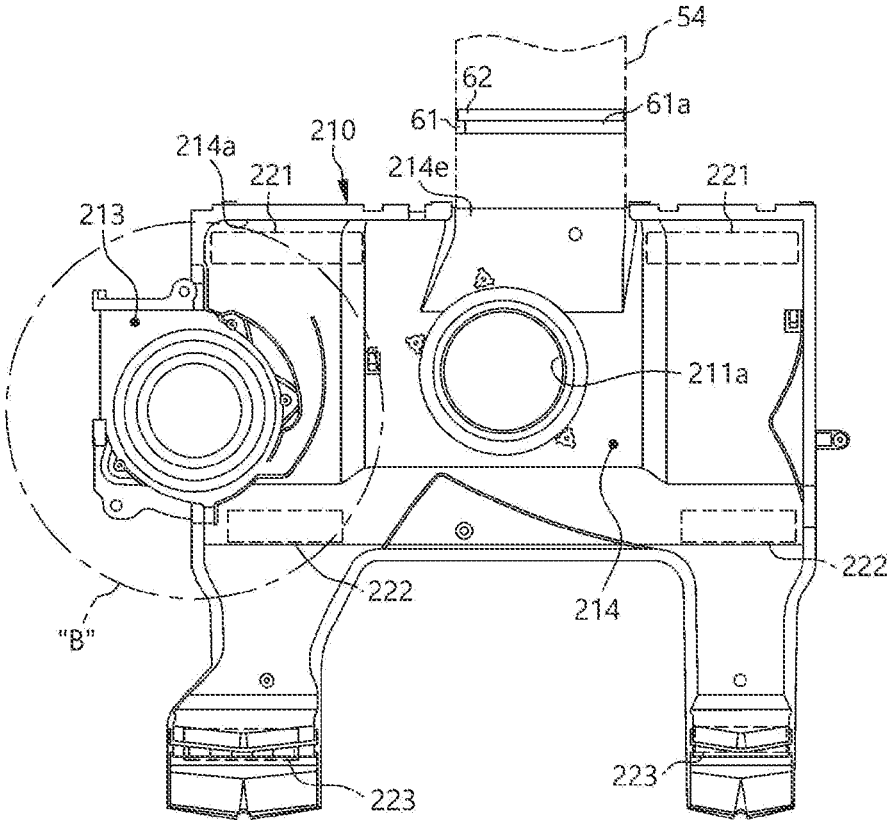
FIG. 33 is a front view showing a shroud of the freezing compartment side grille fan assembly of the refrigerator according to the embodiment of the present disclosure.
Figure 34:
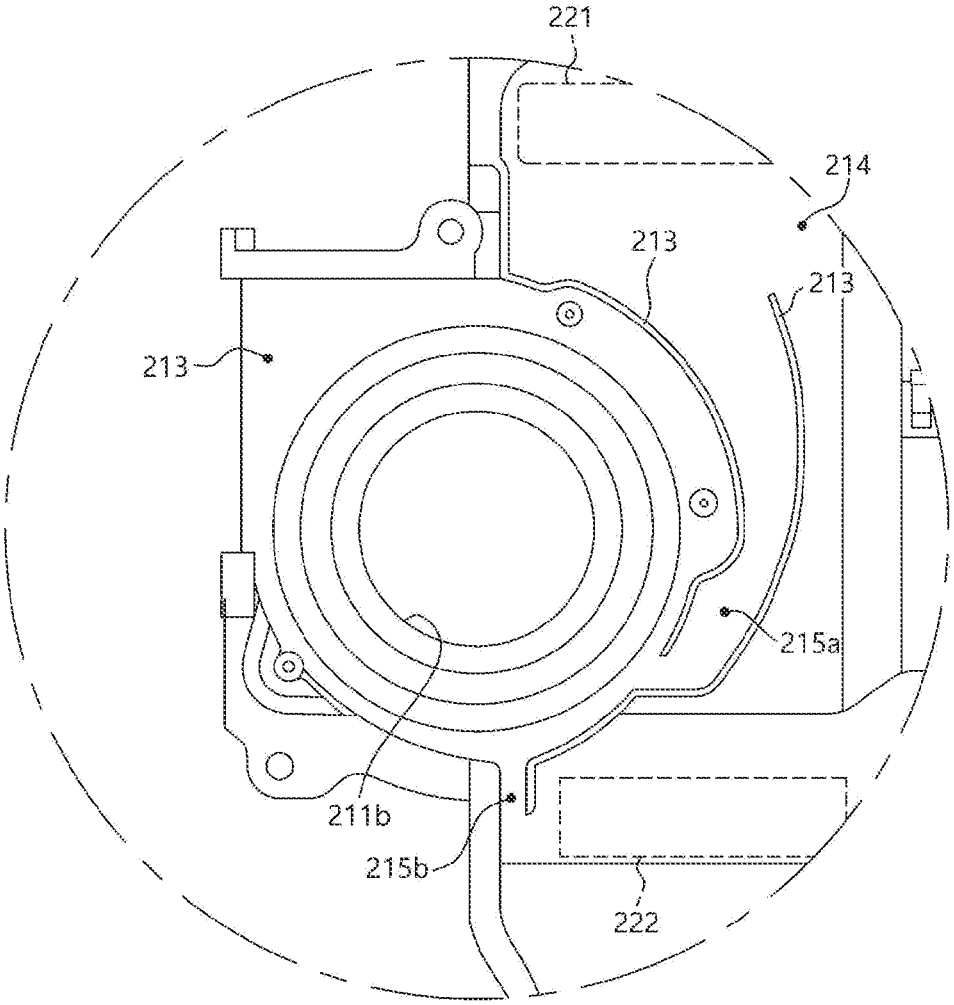
FIG. 34 is an enlarged view of part B in FIG. 33.
Figure 35:
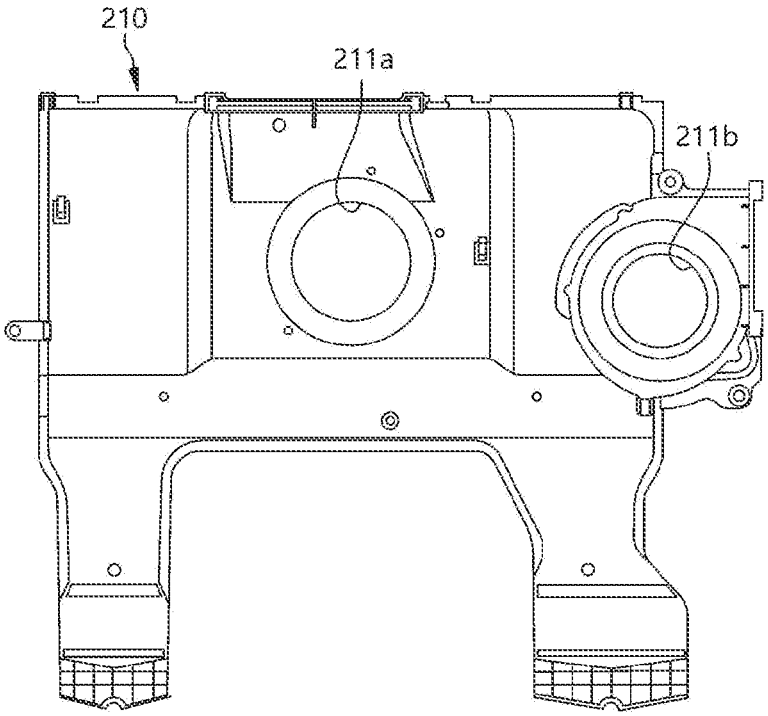
FIG. 35 is a rear view showing the shroud of the freezing compartment side grille fan assembly of the refrigerator according to the embodiment of the present disclosure.
Figure 36:
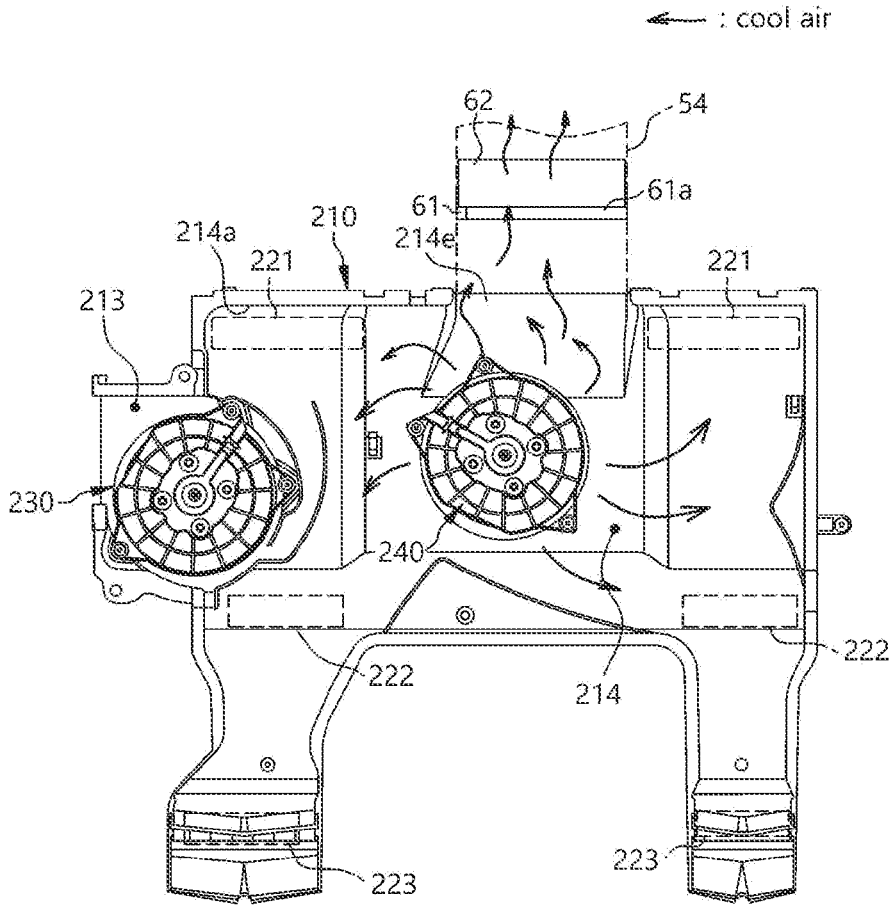
FIG. 36 is a state view showing a cool air flow in the freezing compartment side grille fan assembly when the temperature in the refrigerating compartment of the refrigerator of the present disclosure is controlled.
Figure 37:
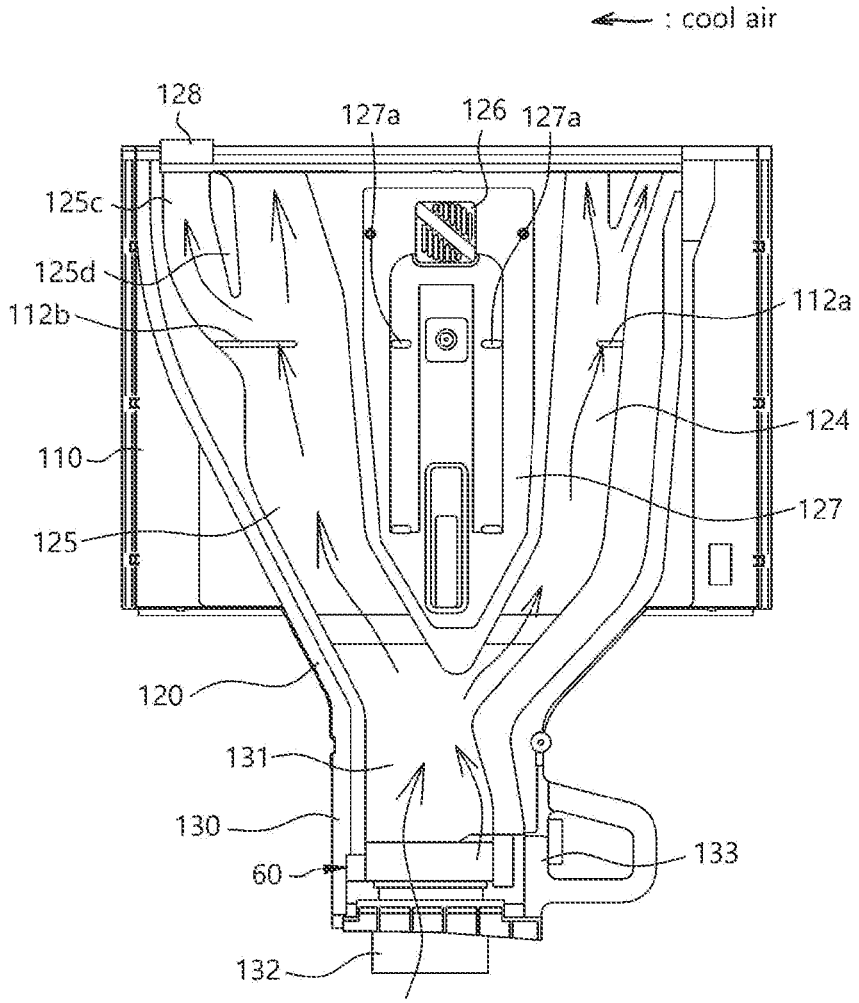
FIG. 37 is a state view showing a cool air flow in the refrigerating compartment side grille fan assembly when the temperature in the refrigerating compartment of the refrigerator of the present disclosure is controlled.
Figure 38:
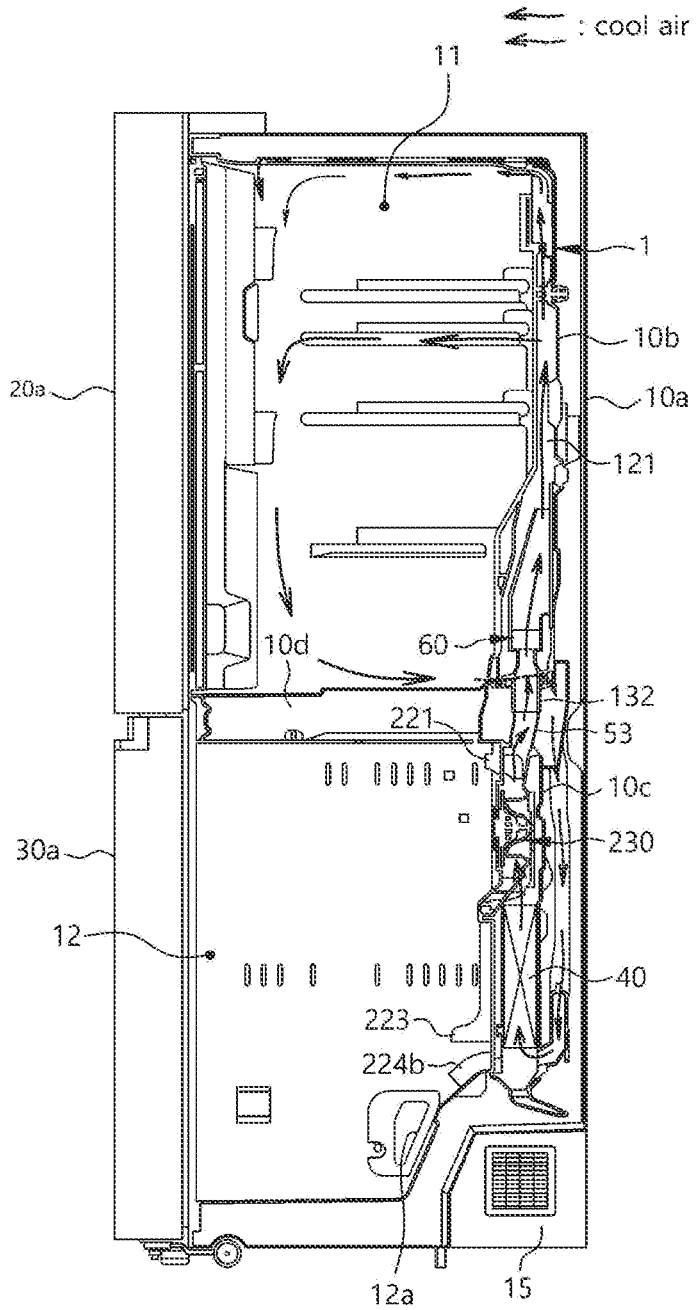
FIG. 38 is a side section view showing a cool air flow when the temperature in the refrigerating compartment of the refrigerator of the present disclosure is controlled.
Figure 39:
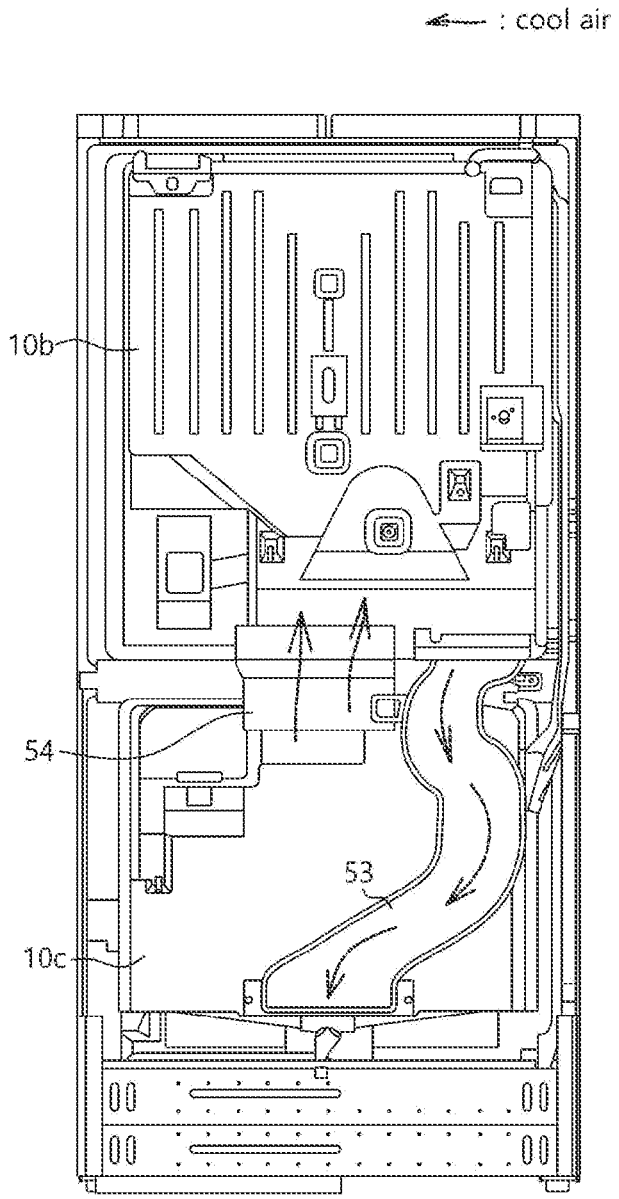
FIG. 39 is a state view showing cool air flows in a connection duct and a recovery duct for the refrigerating compartment when the temperature in the refrigerating compartment of the refrigerator of the present disclosure is controlled.

FIG. 30 is a front view showing the freezing compartment side grille fan assembly of the refrigerator according to the embodiment of the present disclosure. FIG. 31 is a rear view showing the freezing compartment side grille fan assembly of the refrigerator according to the embodiment of the present disclosure. FIG. 32 is a rear view showing a grille fan of the freezing compartment side grille fan assembly of the refrigerator according to the embodiment of the present disclosure. FIG. 33 is a front view showing a shroud of the freezing compartment side grille fan assembly of the refrigerator according to the embodiment of the present disclosure.

As shown in the drawings, the freezing compartment side grille fan assembly 2 includes a shroud 210 and a grille panel 220.

The shroud 210 provides a rear wall surface of the freezing compartment side grille fan assembly 2, and the grille panel 220 forms a front wall surface of the freezing compartment side grille fan assembly 2.

The evaporator 40 is located in a portion of a rear wall surface in the cabinet 10 (a rear wall surface in the inner casing), the portion being located in rear of the freezing compartment 12. The shroud 210 is located in front of the evaporator 40.

Further, the shroud 210 includes a first inlet hole 211*a* and a second inlet hole 211*b* that are formed through the shroud 210.

The two inlet holes 211*a* and 211*b* are configured to cool air that is heat-exchanged by passing through the evaporator 40 located in rear of the freezing compartment 12 to a space between the grille panel 220 and the shroud 210.

On a front surface of the shroud 210, a freezing fan module 240 is provided in a portion where the first inlet hole 211*a* is formed and an ice-making fan module 230 is provided in a portion where the second inlet hole 211*b* is formed.

In particular, the first inlet hole 211*a* is formed in a center portion of an upper end of the shroud 210. The second inlet hole 211*b* is formed in one side portion of the first inlet hole 211*a*.

In addition, the cool air passage 213 for the ice-making compartment and the cool air passage 214 for the freezing compartment are respectively formed at the front surface of the shroud 210 (referring to FIGS. 27 and 33).

The cool air passage 213 for the ice-making compartment is a passage that guides cool air passing through the second inlet hole 211*b* and flowing into a gap between the shroud 210 and the grille panel 220 to flow into a connection portion with the cool air duct 51 for the ice-making compartment.

The cool air passage 214 for the freezing compartment is a passage that guides the cool air passing through the first inlet hole 211*a* and flowing into the gap between the shroud 210 and the grille panel 220 to an upper compartment, a middle compartment, and the lower compartment of the freezing compartment 12.

The cool air passage 214 for the freezing compartment and the cool air passage 213 for the ice-making compartment may be formed by recessing at least one surface of the front surface of the shroud 210 or a rear surface of the grille panel 220, or may be formed of separate ribs protruding from the front surface of the shroud 210 or the rear surface of the grille panel 220.

In addition, a cool air outlet 214*e* is provided in an upper wall surface 214*a* of the shroud 210.

The cool air outlet 214*e* is open to communicate with a part of the cool air passage 214 for the freezing compartment and is located directly above the freezing fan module 240. One end of the connection passage 54 is connected to the cool air outlet 214*e*.

In particular, the cool air outlet 214*e* is formed to be inclined or rounded to the rear of the freezing compartment side grille fan assembly 2 as the cool air outlet 214*e* goes upward from a portion where the first inlet hole 211*a* is provided (a portion where the freezing fan module is located). Accordingly, the cool air outlet 214*e* is formed such that an opening thereof is gradually larger toward a cool air outlet side thereof, so that a sufficiently large amount of cool air may be supplied to the refrigerating compartment 11.

Further, the cool air passage 214 for the freezing compartment and the cool air passage 213 for the ice-making compartment are configured to be partitioned by passage ribs 213*a* and 213*b* (shown in FIG. 20). That is, the passage ribs 213*a* and 213*b*, which are placed between the cool air passage 214 for the freezing compartment and the cool air passage 213 for the ice-making compartment, are formed on the front surface of the shroud 210, so that the cool air passage 214 for the freezing compartment and the cool air passage 213 for the ice-making compartment may be separated from each other.

The passage ribs 213*a* and 213*b* include a first circumferential passage rib 213*a* and a second circumferential passage rib 213*b* that are formed along a circumference of the second inlet hole 211*b*.

The portion where the second inlet hole 211*b* is provided may be partitioned from the cool air passage 214 for the freezing compartment by the two circumferential passage ribs 213*a* and 213*b*. The cool air passing through the second inlet hole 211*b* may be blown along the cool air passage 213 for the ice-making compartment formed by the passage rib 213*a*, 213*b* into the cool air duct 51 for the ice-making compartment.

The first circumferential passage rib 213*a* is configured to cross between the first inlet hole 211*a* and the second inlet hole 211*b* on the front surface of the shroud 210. That is, as the first circumferential passage rib 213*a* is configured to block between the ice-making fan module 230 and the freezing fan module 240, the cool air provided from the freezing fan module 240 is prevented from being directly discharged to a cool air outlet of the cool air passage 213 for the ice-making compartment.

In addition, the first circumferential passage rib 213*a* is rounded to surround a part of a circumference at one side (a side of the freezing fan module is located) of the ice-making fan module 230. Accordingly, the cool air blown while rotating in a circumferential direction of the ice-making fan module 230 by the operation of the ice-making fan module 230 may flow toward the communication portion with the cool air duct 51 for the ice-making compartment by guidance of the first circumferential passage rib 213*a*.

The second circumferential passage rib 213*b* is configured to surround a lower circumference of a portion where the ice-making fan module 230 is installed, on the front surface of the shroud 210. That is, the second circumferential passage rib 213*b* divides the lower portion of the ice-making fan module 230 from the center portion between the ice-making fan module 230 and the freezing fan module 240.

In addition, the second circumferential passage rib 213*b* is rounded to surround the lower circumference of the ice-making fan module 230.

Further, the two circumferential passage ribs 213*a* and 213*b* are configured to be spaced apart from each other.

Whereby, an upper shared passage 215*a* is provided between an end of the first circumferential passage rib 213*a* and an end of the second circumferential passage rib 213*b*.

The cool air passage 214 for the freezing compartment and the cool air passage 213 for the ice-making compartment share the cool air through the upper shared passage 215*a*. That is, when the ice-making fan module 230 is operated, part of cool air flowing in the cool air passage 213 for the ice-making compartment is supplied to the cool air passage 214 for the freezing compartment through the upper shared passage 215*a*. Accordingly, a sufficient amount of cool air may be supplied to the freezing compartment 12 or the refrigerating compartment 11.

In particular, as the second circumferential passage rib 213*b* is located to surround an outer circumference of a lower end of the first circumferential passage rib 213*a*, the upper shared passage 215*a* provided between the two circumferential passage ribs 213*a* and 213*b* discharges cool air toward an upper space in the cool air passage 214 for the freezing compartment.

Further, a lower shared passage 215*b* may be provided in a lower portion of the second circumferential passage rib 213*b*.

The lower shared passage 215*b* is provided to guide the supply of the cool air to a lower surface side in the cool air passage 214 for the freezing compartment. When only the ice-making fan module 230 is operated, the lower shared passage 215*b* supplies the cool air to the freezing compartment 12 to solve the pressure difference between the cool air passage 214 for the freezing compartment (or freezing compartment) and the cool air passage 213 for the ice-making compartment.

The condensed water in the cool air passage 213 for the ice-making compartment may be discharged to the outside thereof through the lower shared passage 215*b*. Therefore, malfunction such as freezing of the ice-making fan module may be prevented.

Further, the grille panel 220 has a plurality of cool air outlets 221, 222, and 223.

Figure 22:
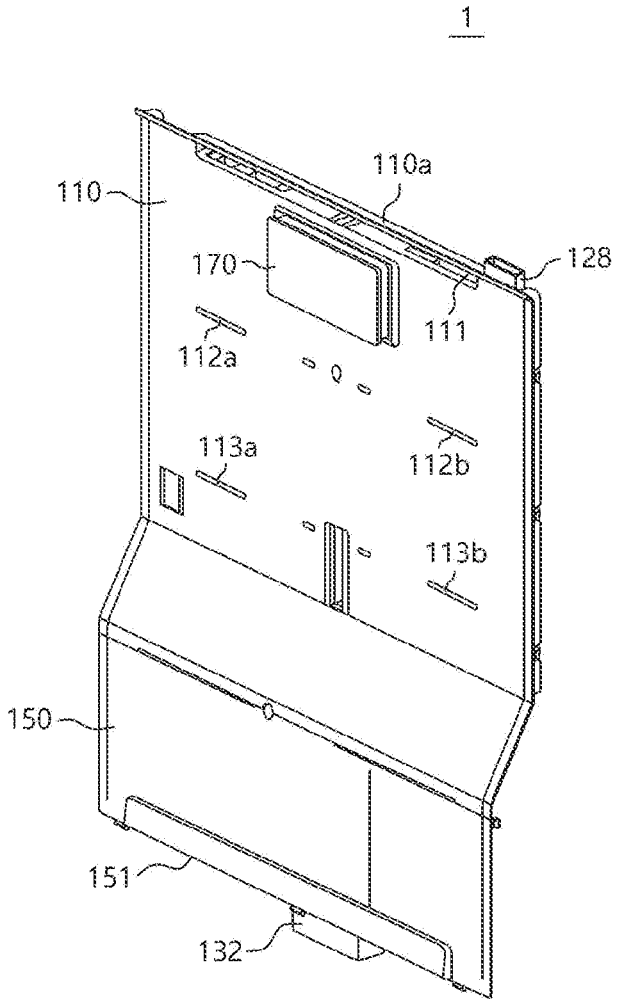
FIG. 22 is a perspective view from the front of the refrigerator, the view showing a state in which a lower grille panel is additionally provided in the refrigerating compartment side grille fan assembly of the refrigerator according to the embodiment of the present disclosure.
Figure 23:
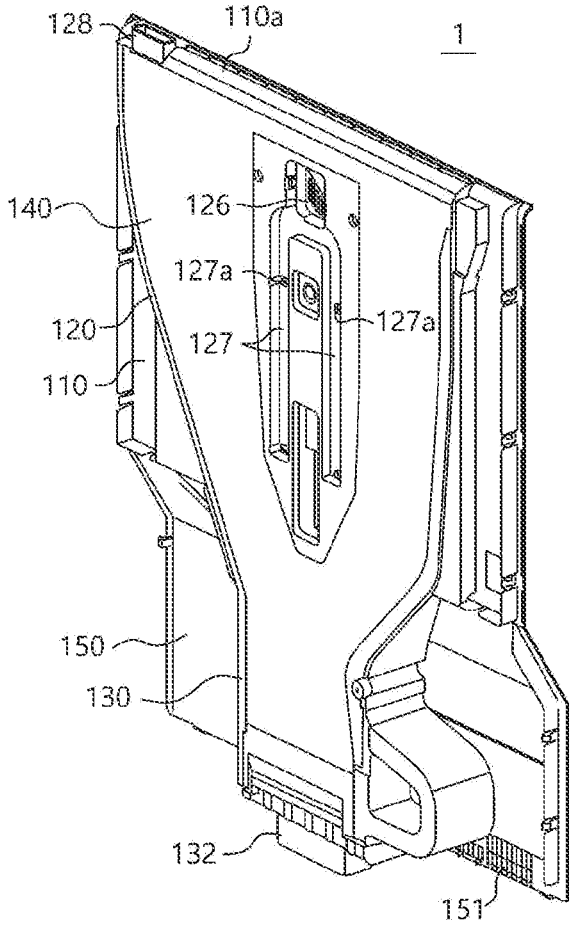
FIG. 23 is a perspective view from the rear of the refrigerator, the view showing the state in which the lower grille panel is additionally provided in the refrigerating compartment side grille fan assembly of the refrigerator according to the embodiment of the present disclosure.
Figure 24:
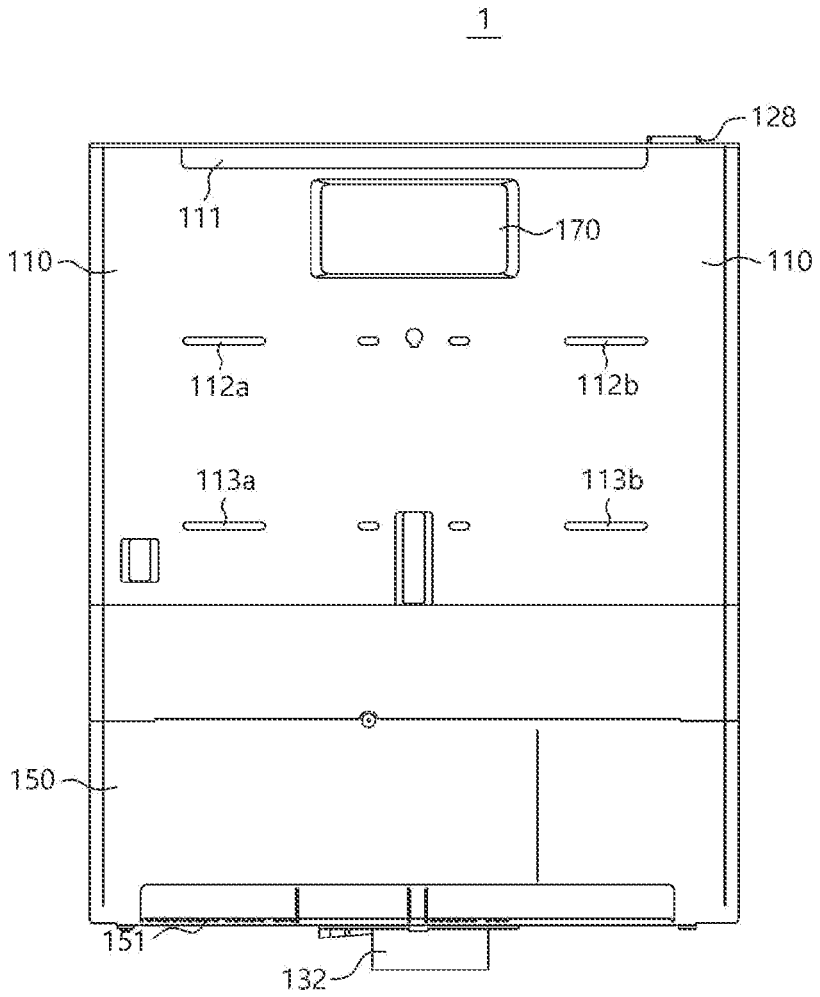
FIG. 24 is a front view showing the state in which the lower grille panel is additionally provided in the refrigerating compartment side grille fan assembly of the refrigerator according to the embodiment of the present disclosure.
Figure 25:
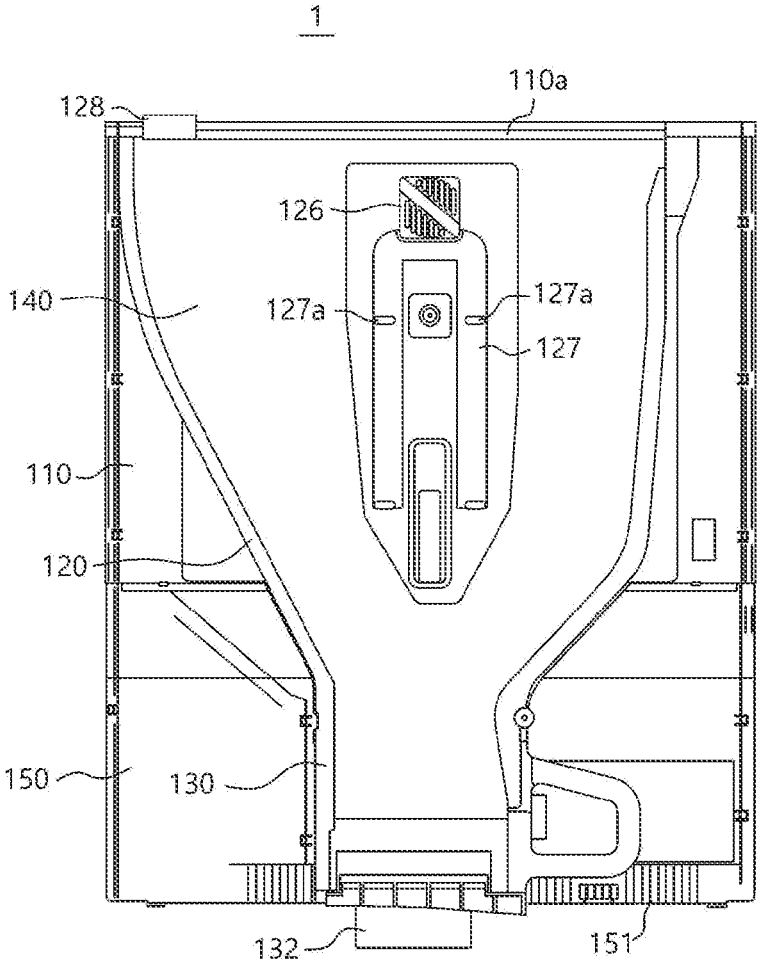
FIG. 25 is a rear view showing the state in which the lower grille panel is additionally provided in the refrigerating compartment side grille fan assembly of the refrigerator according to the embodiment of the present disclosure.

The cool air outlets 221, 222, and 223 includes a cool air outlet 221 for the upper compartment discharging cool air to the upper compartment of the freezing compartment 12, a cool air outlet 222 for the middle compartment discharging cool air to the middle compartment of the freezing compartment 12, and a cool air outlet 223 for the lower compartment discharging cool air to the lower compartment of the freezing compartment 12. The cool air outlets are as shown in FIGS. 22 to 24.

Further, the grille panel 220 has suction guides 224*a* and 224*b* guiding the recovery flow of the cool air flowing in the freezing compartment 12. The suction guides 224*a* and 224*b* are provided in lower ends of the grille panel 220 and are configured to allow the cool air recovered after circulating in the freezing compartment 12 to flow into a lower end of the evaporator 40.

Each of the suction guides 224*a* and 224*b* is formed to be inclined (or rounded) at an angle the same (or similar) to a wall constituting the rear side bottom of the freezing compartment 12, as the suction guide goes to the lower end thereof. That is, the cool air flowing along a lower surface of the freezing compartment 12 may be guided by the suction guides 224*a* and 224*b* to smoothly flow to the lower end of the evaporator 40.

In particular, the suction guides 224*a* and 224*b* includes a first suction guide 224*a*, which is provided in one side in the lower ends of the grille panel 220 on the basis of the center portion of the grille panel 220, the side where the second end 52*b* of the recovery duct 52 for the ice-making compartment is located. The suction guides 224*a* and 224*b* includes a second suction guide 224*b*, which is provided another side in the lower ends of the grille panel 220 on the basis of the center portion of the grille panel 220, the side opposite to the first suction guide 224*a*. That is, cool air flowing through one space (a space communicating with the second end of the recovery duct for the ice-making compartment) in the freezing compartment 12 is recovered through the first suction guide 224*a*, and cool air flowing through another space in the freezing compartment 12 is recovered through the second suction guide 224*b*.

Hereinbelow, according to the embodiment of the present disclosure, the temperature control process for the refrigerating compartment, the freezing compartment 12, and the ice-making compartment 21 of the refrigerator will be described in detail.

The temperature control process of the refrigerating compartment 11 may be described with reference to FIGS. 36 to 39.

The temperature control of the refrigerating compartment 11 is performed by the operations of the freezing fan module 240, the compressor (not shown), and the passage gate 60.

That is, the passage gate 60 is operated, so that the connection passage 54 and the cool air passage 121 for the refrigerating compartment are opened to each other (referring to FIG. 8). Then, when the freezing fan module 240 rotates and the compressor is operated by power supply to the freezing fan module 240, the heat exchange of the evaporator 40 is performed, and thus the operation for controlling the temperature in the refrigerating compartment 11 is performed.

When the freezing fan module 240 is operated, air in the freezing compartment 12 flows to pass through the evaporator 40 by a blowing force of the freezing fan module 240, thereby being heat-exchanged while passing through the evaporator 40.

Further, the heat exchanged air (cool air) passes through the first inlet hole 211*a* of the shroud 210 and then flows into the cool air passage 214 for the freezing compartment.

The cool air introduced into the cool air passage 214 for the freezing compartment and blown to the upper space in the cool air passage 214 for the freezing compartment is discharged through the cool air outlet 214*e*.

Further, the cool air discharged through the cool air outlet 214*e* flows into the third cool air passage 131 for the refrigerating compartment formed in the protrusion 130 of the refrigerating compartment side grille fan assembly 1 by guidance of the connection passage 54.

Then, the cool air introduced into the third cool air passage 131 for the refrigerating compartment flows upward along the third cool air passage 131 for the refrigerating compartment to be supplied to the first cool air passage 124 for the refrigerating compartment and the second cool air passage 125 for the refrigerating compartment. Continuously, the cool air flows upward along the first cool air passage 124 for the refrigerating compartment and the second cool air passage 125 for the refrigerating compartment, and part of the cool air is supplied to the middle compartment side space in the refrigerating compartment 11 by passing through the first cool air out let 112*a* for the middle compartment communicating with the first cool air passage 124 for the refrigerating compartment and the second cool air outlet 112*b* for the middle compartment communicating with the second cool air passage 125 for the refrigerating compartment. The remaining cool air is supplied to the upper compartment side space in the refrigerating compartment 11 by passing through the cool air outlet 111 for the upper compartment communicating with the upper ends of the first cool air passage 124 for the refrigerating compartment and the second cool air passage 125 for the refrigerating compartment.

In addition, part of cool air flowing to an upper end of the second cool air passage 125 for the refrigerating compartment is directly supplied to a front side space in the refrigerating compartment 11 through the upper connection duct 128 connected to the branched passage 125*c* and the guide duct 129.

The first cool air passage 124 for the refrigerating compartment is configured to receive cool air less than the second cool air passage 125 for the refrigerating compartment, the first cool air outlet 112*a* for the middle compartment communicating with the first cool air passage 124 for the refrigerating compartment has the communication portion smaller than the communication portion of the second cool air outlet 112*b* for the middle compartment communicating with the second cool air passage 125 for the refrigerating compartment.

Considering the above structure, cool air supplied to the refrigerating compartment 11 through the second cool air outlet 112*b* for the middle compartment is larger than cool air supplied to the refrigerating compartment 11 through the first cool air outlet 112*a* for the middle compartment. Accordingly, the temperature deviation between the opposite spaces in the refrigerating compartment 11 caused by the ice-making compartment 21 may be reduced.

Meanwhile, cool air flowing in the refrigerating compartment 11 is supplied to the recovery duct 53 for the refrigerating compartment through the cool air recovery port 151 formed in the lower grille panel 150. Continuously, the cool air repeats circulation in which the cool air is recovered to the cool air inlet side of the evaporator 40 located in the refrigerating compartment side inner casing 10*c* by guidance of the recovery duct 53 for the refrigerating compartment.

When the inside of the refrigerating compartment 11 reaches a preset temperature by the above-described operation, the passage gate 60 is operated to block between the connection passage 54 and the third cool air passage 131 for the refrigerating compartment. As a result, additional cool air supply to the refrigerating compartment 11 is not performed.

Figure 40:
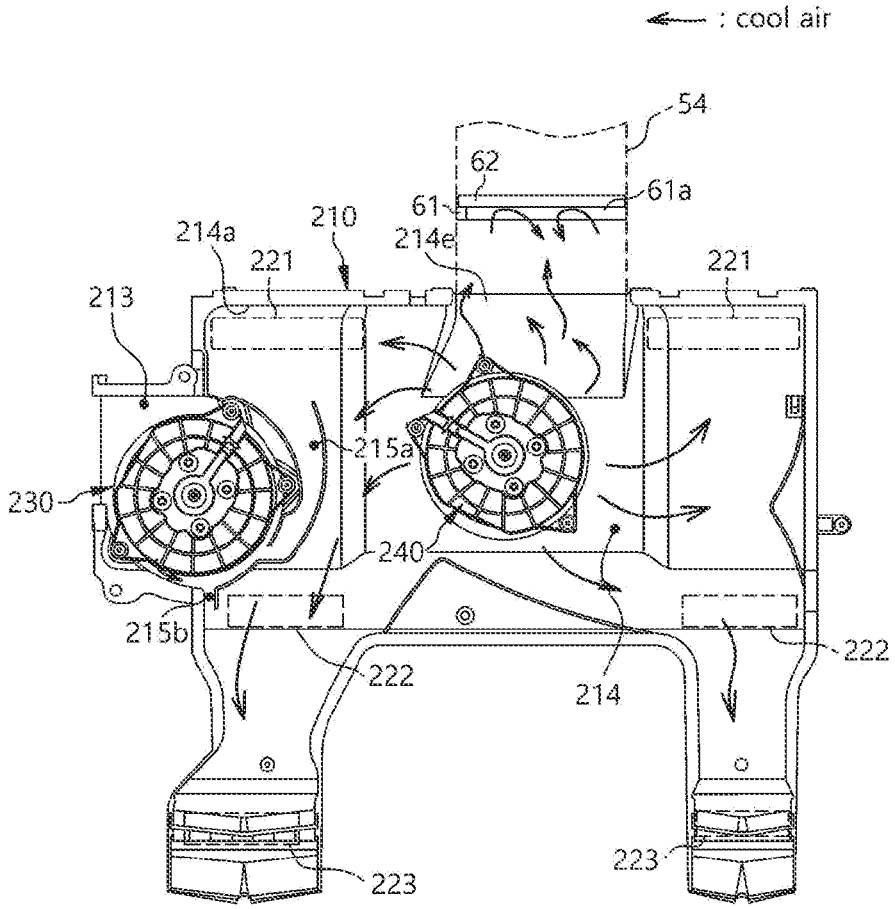
FIG. 40 is a state view showing a cool air flow in the freezing compartment side grille fan assembly when the temperature in the freezing compartment of the refrigerator of the present disclosure is controlled.
Figure 41:
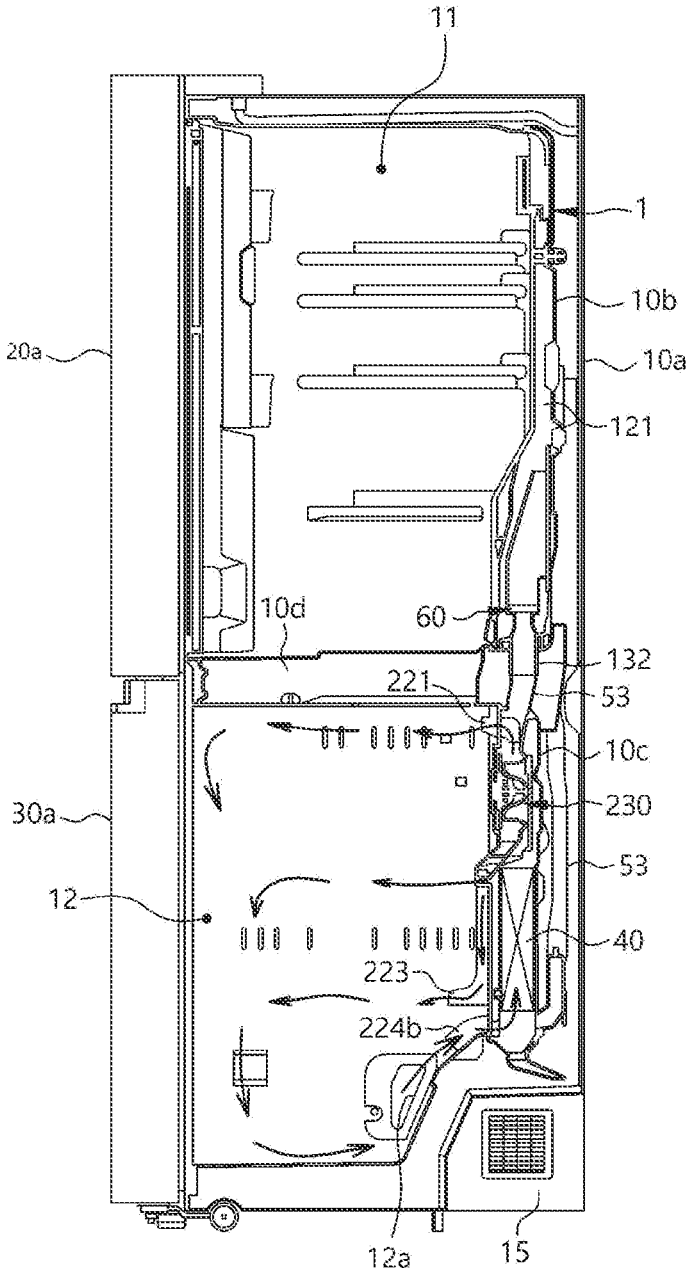
FIG. 41 is a state view showing a cool air flow in the refrigerating compartment side grille fan assembly when the temperature in the freezing compartment of the refrigerator according to the embodiment of the present disclosure is controlled.

Hereinbelow, the process of controlling the temperature in the freezing compartment 12 will be described with reference to FIGS. 40 and 41.

The temperature control of the freezing compartment 12 is performed by the operations of the freezing fan module 240 and the compressor (not shown). That is, by the operation of the freezing fan module 240 and the heat exchange of the evaporator 40 due to the operation of the compressor, the operation for the temperature control of the freezing compartment 12 is performed. The passage gate 60 is operated to block between the connect ion passage 54 and the third cool air passage 131 for the refrigerating compartment.

When the freezing fan 231 of the freezing fan module 240 is operated, air in the freezing compartment 12 flows to pass through the evaporator 40 by the air blowing force of the freezing fan 231, thereby passing through the evaporator 40 and being heat-exchanged.

The heat exchanged air (cool air) passes through the first inlet hole 211*a* of the shroud 210 and then flows into the cool air passage 214 for the freezing compartment.

The cool air introduced into the cool air passage 214 for the freezing compartment and blown to the upper space in the cool air passage 214 for the freezing compartment is discharged to the upper compartment in the freezing compartment 12 through the cool air outlet 221 for the upper compartment in the cool air passage 214 for the freezing compartment. The cool air blown to a lower side in the cool air passage 214 for the freezing compartment is discharged to the middle compartment and the lower compartment in the freezing compartment 12 through the cool air outlet 222 for the middle compartment and the two cool air outlets 223 for the lower compartment.

Further, the cool air supplied into the two freezing compartments 12 by passing through the cool air outlets 221, 222, and 223 flows in the freezing compartment 12, and then the two suction guides 224*a* and 224*b* formed in the grille panel 220 guides the cool air to be recovered to the cool air inlet side of the evaporator 40.

Meanwhile, during the temperature control of the freezing compartment 12, the ice-making fan module 230 may also be operated.

That is, in the case of the ice-making operation, the ice-making fan module 230 is set to be always operated except for special conditions (e.g., when ice is in full in the ice-making compartment). Considering the above state, the ice-making operation may be continuously performed during the freezing operation.

However, when the ice-making operation is performed when the freezing operation is performed, the flow of cool air flowing through the second inlet hole 211*b* and the cool air passage 213 for the ice-making compartment in order is generated by the operation of the ice-making fan module 230.

In particular, part of the cool air generated by the operation of the ice-making fan module 230 is supplied into the cool air passage 214 for the freezing compartment through the upper shared passage 215*a*. The remaining cool air is supplied into the ice-making compartment 21 through the cool air duct 51 for the ice-making compartment connected to the cool air passage 213 for the ice-making compartment.

That is, part of cool air passing through the second inlet hole 211*b* and flowing and blown into the cool air passage 213 for the ice-making compartment passes through the upper shared passage 215*a* and is supplied to the upper space in the cool air passage 214 for the freezing compartment. Other part of the cool air passes through the lower shared passage 215*b* is supplied to a lower space in the cool air passage 214 for the freezing compartment. The remaining part of the cool air is supplied to the ice-making compartment 21 through the cool air duct 51 for the ice-making compartment connected to a cool air outlet side of the cool air passage 213 for the ice-making compartment.

Figure 42:
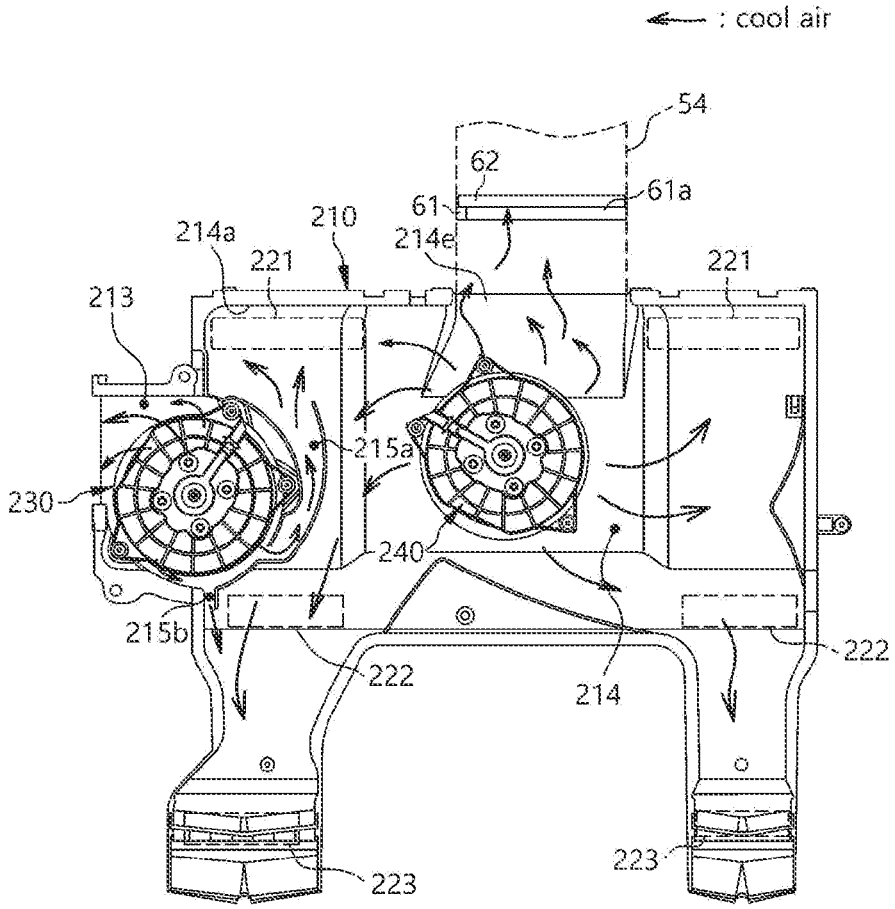
FIG. 42 is a state view showing a cool air flow in the freezing compartment side grille fan assembly when the freezing compartment and the ice-making compartment of the refrigerator according to the embodiment of the present disclosure are operated at the same time.

Therefore, in the freezing compartment 12, not only the cool air blown by the operation of the freezing fan module 240 but also the cool air blown by the operation of the ice-making fan module 230 are supplied, so that sufficient cool air may be supplied. The above structure is as shown in FIG. 42.

In particular, the cool air supplied through the upper shared passage 215*a* is provided to the upper compartment of one space in the both side spaces in the freezing compartment 12, the space at a side communicating with the recovery duct 52 for the ice-making compartment. Whereby, sufficient cool air may be supplied to the freezing compartment 12.

In addition, the cool air supplied through the lower shared passage 215*b* is provided in a lower compartment of one space among the both side spaces of the freezing compartment 12, the space at a side communicating with the recovery duct 52 for the ice-making compartment. Therefore, even when the cool air passing through the ice-making compartment 21 through the recovery duct 52 for the ice-making compartment is recovered, a sudden change of the temperature in the space is prevented. In addition, the opposite spaces in the freezing compartment 12 may be maintained within the same (or similar) temperature range.

Further, when the freezing operation (or ice-making operation) is performed or each operation is stopped, condensed water may be generated due to temperature difference between the cool air passage 213 for the ice-making compartment and the refrigerating compartment 11, or the cool air duct 51 for the ice-making compartment and the refrigerating compartment 11.

However, the generated condensed water flows down the second circumferential passage rib 213*b* of the cool air passage 213 for the ice-making compartment along the cool air duct 51 for the ice-making compartment. Continuously, the condensed water is introduced into the cool air passage for the freezing compartment through the lower shared passage 215*b* formed in the second circumferential passage rib 213*b*, and then is discharged to the outside of the freezing compartment side grille fan assembly 2.

Accordingly, a malfunction of the ice-making fan module 230 due to the condensed water freezing in the cool air passage 213 for the ice-making compartment without being drained may be prevented.

Figure 43:
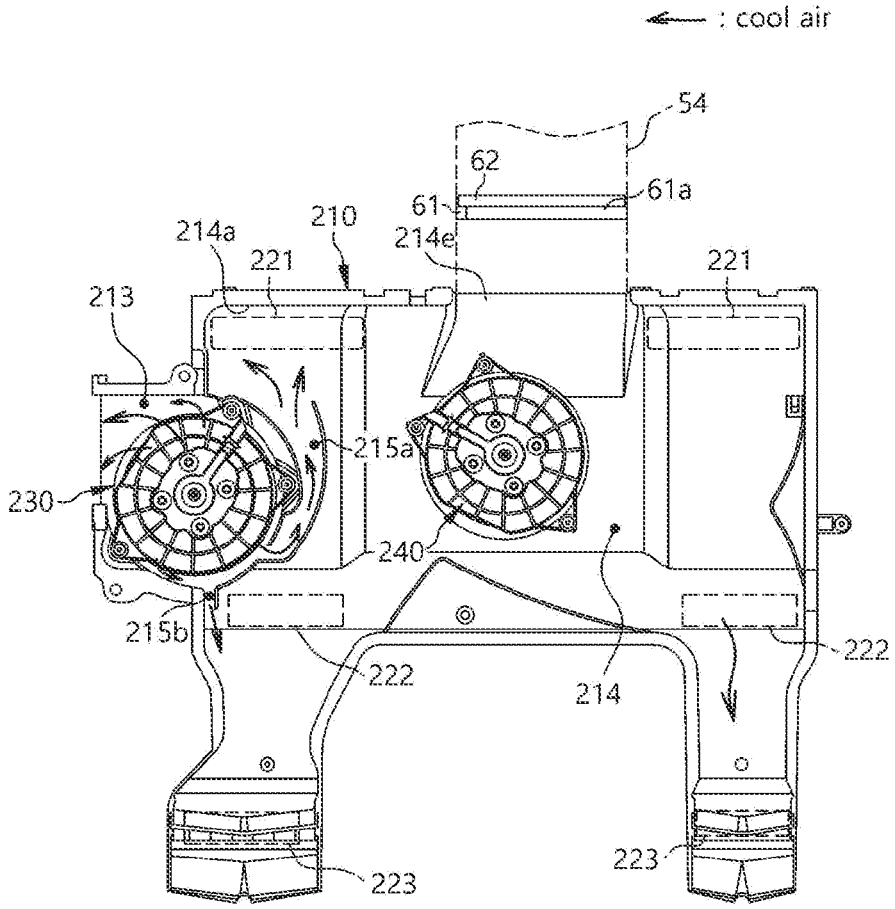
FIG. 43 is a state view showing a cool air flow in the freezing compartment side grille fan assembly when the temperature in the ice-making compartment of the refrigerator according to the embodiment of the present disclosure is controlled.
Figure 44:
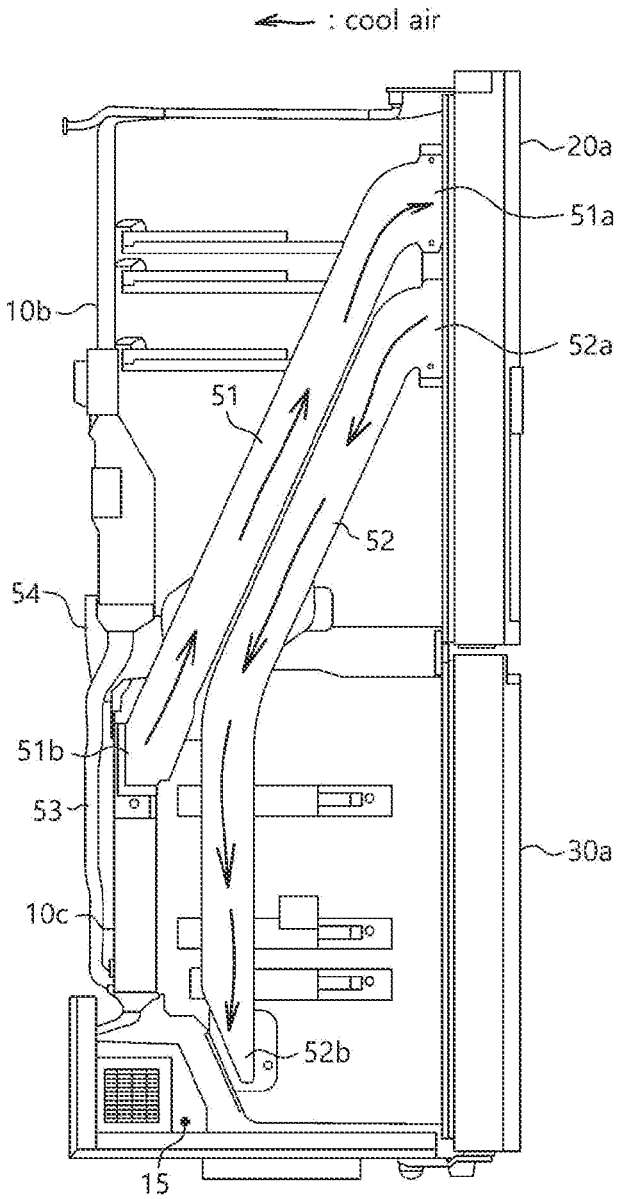
FIG. 44 is a side view showing a cool air flow when the temperature in the ice-making compartment of the refrigerator according to the embodiment of the present disclosure is controlled.
Figure 45:
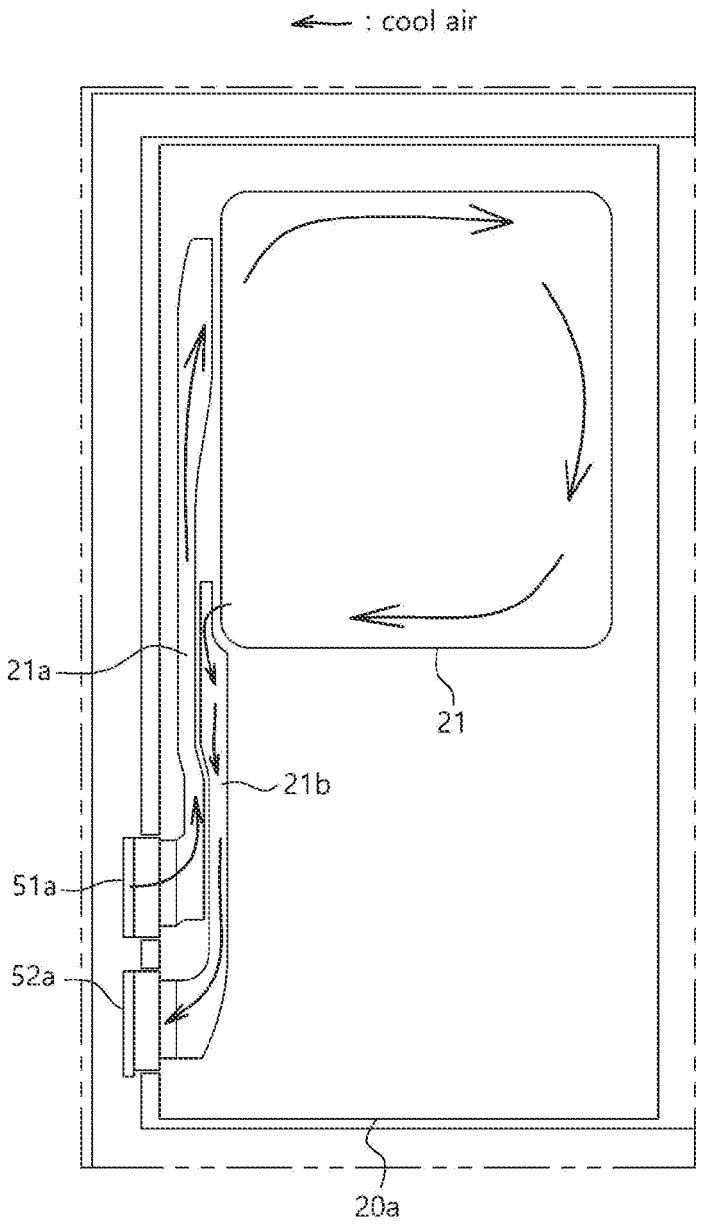
FIG. 45 is a state view schematically showing a cool air flow in the ice-making compartment when the temperature in the ice-making compartment of the refrigerator according to the embodiment of the present disclosure is controlled.

Hereinbelow, the operation for controlling the temperature in the ice-making compartment 21 (ice-making operation) will be described with reference to FIGS. 43 to 45.

The temperature control of the ice-making compartment 21 is performed by the operation of the ice-making fan module 230. At this time, the compressor may be operated or stopped in response to the operating conditions of the freezing compartment 12.

When the ice-making fan module 230 is operated, air in the freezing compartment 12 passes through the evaporator 40 by an air blowing force of the ice-making fan module 230 and passes through the second inlet hole 211*b* of the shroud 210 to be introduced into the cool air passage 213 for the ice-making compartment. Continuously, the air is discharged through a communication portion with the cool air passage 213 for the ice-making compartment. The above operation is as shown in FIGS. 43 and 44.

That is, part of the cool air, the air passing through the second inlet hole 211*b* and being introduced and blown into the cool air passage 213 for the ice-making compartment, passes through the upper shared passage 215*a* and is supplied to the upper space in the cool air passage 214 for the freezing compartment. Other part of the cool air passes through the lower shared passage 215*b* and is supplied into a lower space in the cool air passage 214 for the freezing compartment. The remaining part of the cool air is supplied to the ice-making compartment 21 through the cool air duct 51 for the ice-making compartment connected to the cool air outlet side of the cool air passage 213 for the ice-making compartment.

In particular, in the cool air passing through the second inlet hole 211*b* and supplied to the cool air passage 213 for the ice-making compartment by the air blowing force of the ice-making fan module 230, cool air blown to an upper portion of the ice-making fan module 230 and then flows toward the cool air outlet side of the cool air passage 213 for the ice-making compartment by guidance of the cool air passage 213 for the ice-making compartment flows along a sufficient distance from the location where the cool air is blown to a circumference of the ice-making fan module 230 to the cool air outlet side of the cool air passage 213 for the ice-making compartment. Accordingly, it is possible to reduce the flow resistance generated by the portion where the cool air flows in and the portion where the cool air is discharged are located adjacent to each other, or to reduce discharge of cool air flowing back to the second inlet hole 211*b*.

In addition, the inside of the freezing compartment 12 maintains a pressure state similar to a pressure state of the cool air passage 213 for the ice-making compartment by the cool air supplied through the upper shared passage 215*a* and the lower shared passage 215*b*. That is, since the pressures of the freezing compartment 12 and the ice-making compartment 21 are roughly balanced, even when only the ice-making fan module 230 is operated for the ice-making operation, the cool air in the freezing compartment 12 may be prevented from (or, be minimized in) passing through the cool air passage 214 for the freezing compartment and the first inlet hole 211*a* in reverse and flowing into the second inlet hole 211*b* and the cool air passage 213 for the ice-making compartment.

Since the ice-making fan module 230 blows cool air at a high blowing pressure (high rotation speed of ice-making fan), the cool air may be smoothly conveyed to the ice-making compartment 21.

The cool air flowing in the ice-making compartment 21 flows into the recovery duct 52 for the ice-making compartment, and continuously, the cool air is recovered to the freezing compartment 12 by guidance of the recovery duct 52 for the ice-making compartment.

Then, the cool air recovered to the freezing compartment 12 is directly suctioned into the first suction guide 224*a* located opposite to the freezing compartment 12 and is recovered to the cool air inlet side of the evaporator 40.

Accordingly, the temperature in the ice-making compartment 21 is controlled by the above-described repeated circulation of air (cool air).

Therefore, the refrigerator of the present disclosure reduces an unnecessary amount of cool air supplied to the space having the first refrigerating compartment door 20*a* having the ice-making compartment 21 of the spaces of the opposite sides in the refrigerating compartment, but relatively increases the amount of cool air supplied to the opposite space. Accordingly, temperature deviation for the ent ire port ion in the refrigerating compartment 11 may be reduced.

The refrigerator of the present disclosure is a new type refrigerator that allows cool air blown from the freezing compartment side grille fan assembly 2 to be smoothly supplied to the refrigerating compartment side grille fan assembly 1 and facilitates maintenance thereof.

The refrigerator of the present disclosure may use the upper grille panel 110 of the refrigerating compartment side grille fan assembly 1 regardless of the refrigerator module.

The refrigerator of the present disclosure has the cool air passage 214 for the freezing compartment and the cool air passage 213 for the ice-making compartment that may share cool air with each other by provision of the shared passage 215*a*, 215*b*. Accordingly, when the freezing fan module 240 and the ice-making fan module 230 are operated at the same time, cool air may be sufficiently supplied to the freezing compartment 12 and when only the ice-making fan module 230 is operated, cool air may be prevented from flowing back from the freezing compartment 12.

The refrigerator of the present disclosure is configured to supply the cool air to the cool air passage 121 for the refrigerating compartment of the refrigerating compartment side grille fan assembly 1 through the cool air outlet 214*e* formed in the upper wall surface 214*a* of the cool air passage 214 for the freezing compartment and the connection passage 54 connected to the cool air outlet 214*e*. Accordingly, cool air may be selectively supplied to the refrigerating compartment, the freezing compartment, and the ice-making compartment by the single evaporator 40.

The invention claimed is:

1. A refrigerator comprising:

a cabinet having a refrigerating compartment and a freezing compartment;

a first refrigerating compartment door that is located at a first side of a front surface of the cabinet and includes an ice-making compartment, the first refrigerating compartment door being configured to open and close a first space defined at one side of the refrigerating compartment;

a second refrigerating compartment door located at a second side of the front surface of the cabinet opposite to the first side, the second refrigerating compartment door being configured to open and close a second space defined at another side of the refrigerating compartment;

an evaporator located at the freezing compartment and configured to cool air;

a freezing compartment side grille fan assembly located at a front of the evaporator and configured to supply the air cooled by the evaporator to at least one of the freezing compartment or the refrigerating compartment;

a refrigerating compartment side grille fan assembly located at the refrigerating compartment and configured to guide the air from the freezing compartment side grille fan assembly to the refrigerating compartment;

a connection passage that connects between the freezing compartment side grille fan assembly and the refrigerating compartment side grille fan assembly, the connection passage being configured to supply the air from the freezing compartment side grille fan assembly to the refrigerating compartment side grille fan assembly; and a passage gate configured to selectively block the air supplied from the freezing compartment side grille fan assembly to the refrigerating compartment side grille fan assembly, wherein the refrigerating compartment side grille fan assembly comprises:

an upper grille panel that defines a front surface of the refrigerating compartment side grille fan assembly and is exposed to an inside of the refrigerating compartment, and a duct unit that is coupled to a rear surface of the upper grille panel and defines a cool air passage at a rear surface of the duct unit, the cool air passage being configured to guide the air from the connection passage to the refrigerating compartment, and wherein the duct unit comprises a protrusion that is located at a lower portion of the duct unit and protrudes downward relative to a lower surface of the upper grille panel.

2. The refrigerator of claim 1, wherein the cool air passage has:

an upper end that is opened to an upper surface of the duct unit, and a lower end that passes through the protrusion and is opened to a lower surface of the protrusion.

3. The refrigerator of claim 2, wherein the protrusion defines a cool air inlet side of the cool air passage, and wherein the refrigerator further comprises a lower connection duct having:

a first end that is inserted and coupled to the cool air inlet side of the cool air passage, and a second end that protrudes downward from the cool air inlet side and is coupled to the connection passage.

4. The refrigerator of claim 3, wherein the lower connection duct is removably coupled to at least one of the protrusion or the connection passage.

5. The refrigerator of claim 3, wherein the passage gate is located at a cool air outlet side of the lower connection duct and configured to cover a portion of the cool air passage defined in the protrusion.

6. The refrigerator of claim 2, wherein the cool air passage comprises:

a first cool air passage defined at a first side of the rear surface of the duct unit facing the first space of the refrigerating compartment;

a second cool air passage defined at a second side of the rear surface of the duct unit facing the second space of the refrigerating compartment; and a third cool air passage that extends from the protrusion and is connected to lower ends of the first cool air passage and the second cool air passage, the third cool air passage being configured to guide the air received from the freezing compartment side grille fan assembly through the connection passage, and wherein the lower ends of the first and second cool air passages are joined at the third cool air passage.

7. The refrigerator of claim 6, wherein the passage gate is located in the third cool air passage and configured to open and close at least a portion of the third cool air passage.

8. The refrigerator of claim 6, wherein the third cool air passage is configured to supply a larger amount of air to the second cool air passage than to the first cool air passage.

9. The refrigerator of claim 6, wherein a cool air outlet side of the third cool air passage is inclined or rounded toward a cool air inlet side of the second cool air passage to thereby guide the air from the third cool air passage along a direction of the second cool air passage.

10. The refrigerator of claim 9, wherein the first cool air passage is inclined or rounded in another direction that is different from the direction of the second cool air passage and the third cool air passage.

11. The refrigerator of claim 6, wherein a transverse width of the second cool air passage is greater than a transverse width of the first cool air passage.

12. The refrigerator of claim 6, wherein the upper grille panel defines:

a first cool air outlet that faces the first space of the refrigerating compartment and is in fluid communication with the first cool air passage, the first cool air outlet being configured to discharge the air from the first cool air passage to the first space of the refrigerating compartment; and a second cool air outlet that faces the second space of the refrigerating compartment and is in fluid communication with the second cool air passage, the second cool air outlet being configured to discharge the air from the second cool air passage to the second space of the refrigerating compartment, and wherein a size of the second cool air outlet is larger than a size of the first cool air outlet.

13. The refrigerator of claim 6, further comprising:

an upper connection duct located at an upper end of the duct unit and connected to an open upper surface of the second cool air passage; and a guide duct that is located at an upper wall of the refrigerating compartment and extends from the upper connection duct in a forward direction, the guide duct having (i) a rear end connected to the upper connection duct and (ii) a front end connected to the refrigerating compartment, wherein the front end of the guide duct passes through a front side of the upper wall of the refrigerating compartment and is exposed to the inside of the refrigerating compartment.

14. The refrigerator of claim 1, wherein the refrigerating compartment side grille fan assembly is configured to supply a first amount of the air to the first space of the refrigerating compartment and to supply a second amount of the air to the second space of the refrigerating compartment, and wherein the second amount of the air supplied to the second space of the refrigerating compartment is greater than the first amount of the air supplied to the first space of the refrigerating compartment.

15. The refrigerator of claim 1, wherein the refrigerating compartment is located above the freezing compartment.

16. The refrigerator of claim 1, wherein the refrigerating compartment side grille fan assembly further comprises a lower grille panel that is connected to the lower surface of the upper grille panel, and wherein the protrusion extends downward to the lower grille panel.

17. The refrigerator of claim 16, wherein the protrusion comprises a lower connection duct that protrudes downward relative to a lower end of the lower grille panel and is connected to the connection passage.

18. A refrigerator comprising:

a cabinet having a refrigerating compartment and a freezing compartment;

a first refrigerating compartment door configured to open and close a first space defined at one side of the refrigerating compartment, the first refrigerating compartment door including an ice-making compartment;

a second refrigerating compartment door configured to open and close a second space defined at another side of the refrigerating compartment;

an evaporator located at the freezing compartment and configured to cool air;

a freezing compartment side grille fan assembly located at a front of the evaporator and configured to supply the air cooled by the evaporator to at least one of the freezing compartment or the refrigerating compartment;

a refrigerating compartment side grille fan assembly located at the refrigerating compartment and configured to guide the air from the freezing compartment side grille fan assembly to the refrigerating compartment; and a connection passage that connects between the freezing compartment side grille fan assembly and the refrigerating compartment side grille fan assembly, wherein the refrigerating compartment side grille fan assembly comprises a duct unit configured to supply a first amount of the air to the first space of the refrigerating compartment and to supply a second amount of the air to the second space of the refrigerating compartment, wherein the refrigerating compartment side grille fan assembly comprises:

an upper grille panel that defines a front surface of the refrigerating compartment side grille fan assembly and is exposed to an inside of the refrigerating compartment, and a duct unit that is coupled to a rear surface of the upper grille panel and defines a cool air passage at a rear surface of the duct unit, the cool air passage being configured to guide the air from the connection passage to the refrigerating compartment, and wherein the duct unit comprises a protrusion that is located at a lower portion of the duct unit and protrudes downward relative to a lower surface of the upper grille panel.

19. The refrigerator of claim 18, wherein the refrigerating compartment side grille fan assembly further comprises an upper grille panel that defines a front surface of the refrigerating compartment side grille fan assembly and is exposed to an inside of the refrigerating compartment, and wherein the duct unit that is coupled to a rear surface of the upper grille panel and defines a cool air passage at a rear surface of the duct unit, the cool air passage being configured to guide the air from the freezing compartment side grille fan assembly to the refrigerating compartment.

20. The refrigerator of claim 18, wherein the duct unit includes:

a first cool air passage defined at a first side of the duct unit facing the first space of the refrigerating compartment; and a second cool air passage defined at a second side of the duct unit facing the second space of the refrigerating compartment, and wherein a width of the second cool air passage is greater than a width of the first cool air passage.

* * * * *